US008253633B2

(12) United States Patent
Sanz et al.

(10) Patent No.: US 8,253,633 B2
(45) Date of Patent: Aug. 28, 2012

(54) MULTI-BAND MONOPOLE ANTENNA FOR A MOBILE COMMUNICATIONS DEVICE

(75) Inventors: Alfonso Sanz, Barcelona (ES); Carles Puente Baliarda, Barcelona (ES)

(73) Assignee: Fractus, S.A., Barcelona (ES)

( * ) Notice: Subject to any disclaimer, the term of this patent is extended or adjusted under 35 U.S.C. 154(b) by 0 days.

(21) Appl. No.: 12/652,974

(22) Filed: Jan. 6, 2010

(65) Prior Publication Data

US 2010/0123642 A1 May 20, 2010

Related U.S. Application Data

(63) Continuation of application No. 12/055,748, filed on Mar. 26, 2008, now Pat. No. 7,675,470, which is a continuation of application No. 11/713,324, filed on Mar. 2, 2007, now Pat. No. 7,403,164, which is a continuation of application No. 11/124,768, filed on May 9, 2005, now Pat. No. 7,411,556, which is a continuation of application No. PCT/EP02/14706, filed on Dec. 22, 2002.

(51) Int. Cl.
*H01Q 1/24* (2006.01)

(52) U.S. Cl. ..... 343/702; 343/700 MS

(58) Field of Classification Search ..... 343/700 MS, 343/702, 895

See application file for complete search history.

(56) References Cited

U.S. PATENT DOCUMENTS 3,079,602 A 2/1963 Duhamel
3,689,929 A 9/1972 Moody
4,038,662 A 7/1977 Turner
4,123,756 A 10/1978 Nagata et al.
4,318,109 A 3/1982 Weathers
4,356,492 A 10/1982 Kaloi
4,389,651 A 6/1983 Tomasky
4,536,725 A 8/1985 Hubler
4,571,595 A 2/1986 Phillips
4,578,654 A 3/1986 Tait
4,608,572 A 8/1986 Blakney
4,827,271 A 5/1989 Berneking
4,843,468 A 6/1989 Drewery
4,860,019 A 8/1989 Jiang
4,907,011 A 3/1990 Kuo (Continued)

FOREIGN PATENT DOCUMENTS

CN 2224466 4/1996

(Continued)

OTHER PUBLICATIONS

Wimer, Michael C. USPTO Office Action for U.S. Appl. No. 10/422,578; Oct. 4, 2004.

(Continued)

*Primary Examiner* — Tan Ho
(74) *Attorney, Agent, or Firm* — Winstead PC

(57) ABSTRACT

A multi-band monopole antenna for a mobile communications device includes a common conductor coupled to both a first radiating arm and a second radiating arm. The common conductor includes a feeding port for coupling the antenna to communications circuitry in a mobile communications device. In one embodiment, the first radiating arm includes a space-filling curve. In another embodiment, the first radiating arm includes a meandering section extending from the common conductor in a first direction and a contiguous extended section extending from the meandering section in a second direction.

40 Claims, 7 Drawing Sheets

U.S. PATENT DOCUMENTS

| | | | |
|---|---|---|---|
| 5,014,346 | A | 5/1991 | Phillips |
| 5,075,691 | A | 12/1991 | Garay |
| 5,248,988 | A | 9/1993 | Makino |
| 5,307,075 | A | 4/1994 | Huynh |
| 5,337,065 | A | 8/1994 | Bonnet et al. |
| 5,355,318 | A | 10/1994 | Dionnet |
| 5,363,114 | A | 11/1994 | Shoemaker |
| 5,410,322 | A | 4/1995 | Sonoda |
| 5,453,752 | A | 9/1995 | Wang |
| 5,457,469 | A | 10/1995 | Diamond |
| 5,557,293 | A | 9/1996 | McCoy |
| 5,572,223 | A | 11/1996 | Phillips et al. |
| 5,608,417 | A | 3/1997 | de Vall |
| 5,809,433 | A | 9/1998 | Thompson |
| 5,870,066 | A | 2/1999 | Asakura et al. |
| 5,872,546 | A | 2/1999 | Ihara |
| 5,898,404 | A | 4/1999 | Jou |
| 5,918,183 | A | 6/1999 | Janky |
| 5,926,139 | A | 7/1999 | Korisch |
| 5,929,825 | A | 7/1999 | Niu et al. |
| 5,933,330 | A | 8/1999 | Beutler |
| 5,936,587 | A | 8/1999 | Gudilev |
| 5,943,020 | A | 8/1999 | Liebendoerfer et al. |
| 5,963,871 | A | 10/1999 | Zhinong et al. |
| 5,966,098 | A | 10/1999 | Qi |
| 5,986,609 | A | 11/1999 | Spall |
| 5,986,610 | A | 11/1999 | Miron |
| 5,990,838 | A | 11/1999 | Burns |
| 5,990,849 | A | 11/1999 | Salvail et al. |
| 5,995,052 | A | 11/1999 | Sadler |
| 6,011,518 | A | 1/2000 | Yamagishi |
| 6,011,699 | A | 1/2000 | Murray |
| 6,031,505 | A | 2/2000 | Qi |
| 6,087,990 | A | 7/2000 | Thill |
| 6,094,179 | A | 7/2000 | Davidson |
| 6,097,339 | A | 8/2000 | Filipovic |
| 6,104,349 | A | 8/2000 | Cohen |
| 6,111,545 | A | 8/2000 | Saari et al. |
| 6,112,102 | A | 8/2000 | Zhinong et al. |
| 6,122,533 | A | 9/2000 | Zhang |
| 6,130,651 | A | 10/2000 | Yanagisawa et al. |
| 6,140,966 | A | 10/2000 | Pankinaho |
| 6,140,975 | A | 10/2000 | Cohen |
| 6,141,540 | A | 10/2000 | Richards |
| 6,147,655 | A | 11/2000 | Roesner |
| 6,160,513 | A | 12/2000 | Davidson |
| 6,166,694 | A | 12/2000 | Ying et al. |
| 6,181,281 | B1 | 1/2001 | Desclos |
| 6,195,048 | B1 | 2/2001 | Chiba |
| 6,198,442 | B1 | 3/2001 | Rutkowski |
| 6,201,501 | B1 | 3/2001 | Arkko |
| 6,204,826 | B1 | 3/2001 | Rutkowski |
| 6,211,826 | B1 | 4/2001 | Aoki |
| 6,215,474 | B1 | 4/2001 | Shah |
| 6,236,366 | B1 | 5/2001 | Yamamoto |
| 6,239,765 | B1 | 5/2001 | Johnson |
| 6,243,592 | B1 | 6/2001 | Nakada et al. |
| 6,259,407 | B1 | 7/2001 | Tran |
| 6,266,023 | B1 | 7/2001 | Nagy |
| 6,266,538 | B1 | 7/2001 | Waldron |
| 6,271,794 | B1 | 8/2001 | Geeraert et al. |
| 6,275,198 | B1 | 8/2001 | Kenoun et al. |
| 6,281,846 | B1 | 8/2001 | Puente |
| 6,285,327 | B1 | 9/2001 | See |
| 6,288,680 | B1 | 9/2001 | Tsuru |
| 6,300,914 | B1 | 10/2001 | Yang |
| 6,307,511 | B1 | 10/2001 | Ying et al. |
| 6,317,084 | B1 | 11/2001 | Chen |
| 6,329,951 | B1 | 12/2001 | Wen |
| 6,329,962 | B2 | 12/2001 | Ying et al. |
| 6,337,663 | B1 | 1/2002 | Chi-Ming et al. |
| 6,337,667 | B1 | 1/2002 | Ayala et al. |
| 6,343,208 | B1 | 1/2002 | Ying |
| 6,352,434 | B1 | 3/2002 | Emmert |
| 6,353,443 | B1 | 3/2002 | Ying |
| 6,366,243 | B1 | 4/2002 | Isohalata |
| 6,384,790 | B2 | 5/2002 | Dishart et al. |
| 6,408,190 | B1 | 6/2002 | Ying |
| 6,417,816 | B2 | 7/2002 | Sadler |
| 6,445,352 | B1 | 9/2002 | Cohen |
| 6,452,553 | B1 | 9/2002 | Cohen |
| 6,452,556 | B1 | 9/2002 | Ha |
| 6,459,413 | B1 | 10/2002 | Tseng et al. |
| 6,476,769 | B1 | 11/2002 | Lehtola |
| 6,483,462 | B2 | 11/2002 | Weinberger |
| 6,549,789 | B1 | 4/2003 | Kfoury |
| 6,614,400 | B2 | 9/2003 | Egorov |
| 6,664,930 | B2 | 12/2003 | Wen et al. |
| 6,674,405 | B2 | 1/2004 | Wang |
| 6,693,604 | B2 | 2/2004 | Washiro |
| 6,697,022 | B2 | 2/2004 | Ponce De Leon |
| 6,741,215 | B2 | 5/2004 | Grant et al. |
| 6,762,723 | B2 | 7/2004 | Nallo et al. |
| 6,781,548 | B2 | 8/2004 | Wen et al. |
| 6,801,164 | B2 | 10/2004 | Bit-Babik |
| 6,822,611 | B1 | 11/2004 | Kontogeorgakis et al. |
| 6,831,606 | B2 | 12/2004 | Sajadinia |
| 6,839,040 | B2 | 1/2005 | Huber et al. |
| 6,853,352 | B2 | 2/2005 | Nevermann |
| 6,864,854 | B2 | 3/2005 | Dai et al. |
| 6,882,320 | B2 | 4/2005 | Park et al. |
| 6,950,071 | B2 | 9/2005 | Wen |
| 6,963,310 | B2 | 11/2005 | Horita |
| 6,995,720 | B2 | 2/2006 | Shikata |
| 7,015,868 | B2 | 3/2006 | Puente |
| 7,057,560 | B2 | 6/2006 | Erkocevic |
| 7,068,230 | B2 | 6/2006 | Qi |
| 7,069,043 | B2 | 6/2006 | Sawamura |
| 7,081,857 | B2 | 7/2006 | Kinnunen et al. |
| 7,095,372 | B2 | 8/2006 | Soler |
| 7,123,208 | B2 | 10/2006 | Puente |
| 7,126,537 | B2 | 10/2006 | Cohen |
| 7,148,850 | B2 | 12/2006 | Puente Baliarda |
| 7,202,822 | B2 | 4/2007 | Baliarda |
| 7,289,072 | B2 | 10/2007 | Sakurai |
| 7,312,762 | B2 | 12/2007 | Puente |
| 7,342,553 | B2 | 3/2008 | Soler |
| 7,394,432 | B2 | 7/2008 | Baliarda |
| 7,397,431 | B2 | 7/2008 | Baliarda |
| 7,403,164 | B2 | 7/2008 | Sanz et al. |
| 7,411,556 | B2 | 8/2008 | Sanz et al. |
| 7,423,592 | B2 | 9/2008 | Pros et al. |
| 7,446,708 | B1 | 11/2008 | Nguyen et al. |
| 7,463,199 | B2 | 12/2008 | Soler |
| 7,511,675 | B2 | 3/2009 | Puente-Baliarda |
| 7,528,782 | B2 | 5/2009 | Baliarda |
| 7,675,470 | B2 * | 3/2010 | Sanz et al. ..... 343/702 |
| 2001/0002823 | A1 | 6/2001 | Ying |
| 2001/0044320 | A1 | 11/2001 | Ono |
| 2001/0050636 | A1 | 12/2001 | Weinberger |
| 2001/0050637 | A1 | 12/2001 | Aoyama et al. |
| 2002/0000940 | A1 | 1/2002 | Moren et al. |
| 2002/0044090 | A1 | 4/2002 | Bahr et al. |
| 2002/0080088 | A1 | 6/2002 | Boyle |
| 2002/0140615 | A1 | 10/2002 | Puente Baliarda |
| 2002/0149527 | A1 | 10/2002 | Wen |
| 2002/0175866 | A1 | 11/2002 | Gram |
| 2002/0190904 | A1 | 12/2002 | Cohen |
| 2003/0137459 | A1 | 7/2003 | Kim et al. |
| 2003/0184482 | A1 | 10/2003 | Bettin |
| 2003/0210187 | A1 | 11/2003 | Wong et al. |
| 2004/0004574 | A1 | 1/2004 | Wen |
| 2004/0009755 | A1 | 1/2004 | Yoshida |
| 2004/0027295 | A1 | 2/2004 | Huber et al. |
| 2004/0090372 | A1 | 5/2004 | Di Nallo |
| 2004/0095289 | A1 | 5/2004 | Bae et al. |
| 2004/0106428 | A1 | 6/2004 | Shoji |
| 2004/0140938 | A1 | 7/2004 | Kadambi |
| 2004/0203529 | A1 | 10/2004 | Hong et al. |
| 2004/0212545 | A1 | 10/2004 | Li |
| 2005/0237244 | A1 | 10/2005 | Annabi et al. |
| 2005/0239519 | A1 | 10/2005 | Saitou et al. |
| 2005/0259031 | A1 | 11/2005 | Sanz et al. |
| 2006/0028380 | A1 | 2/2006 | Harano |
| 2006/0033668 | A1 | 2/2006 | Ryu |
| 2006/0170610 | A1 | 8/2006 | Rabinovich et al. |
| 2007/0024508 | A1 | 2/2007 | Lee |

| | | | |
|---|---|---|---|
| 2007/0046548 | A1 | 3/2007 | Pros et al. |
| 2007/0103371 | A1 | 5/2007 | Kim et al. |
| 2007/0152887 | A1 | 7/2007 | Castany et al. |
| 2007/0152894 | A1 | 7/2007 | Sanz et al. |
| 2007/0152984 | A1 | 7/2007 | Ording et al. |
| 2007/0194997 | A1 | 8/2007 | Nakanishi et al. |
| 2009/0109101 | A1 | 4/2009 | Baliarda |

FOREIGN PATENT DOCUMENTS

| | | | |
|---|---|---|---|
| EP | 0749176 | | 12/1996 |
| EP | 0766343 | | 4/1997 |
| EP | 0590671 | B1 | 12/1997 |
| EP | 0 884 796 | | 12/1998 |
| EP | 0938158 | A2 | 2/1999 |
| EP | 0902472 | | 3/1999 |
| EP | 0938158 | | 8/1999 |
| EP | 0969375 | A2 | 1/2000 |
| EP | 0 986 130 | | 3/2000 |
| EP | 1011167 | | 6/2000 |
| EP | 1 091 445 | | 4/2001 |
| EP | 1 198 027 | | 4/2002 |
| EP | 0 777 293 | | 7/2002 |
| EP | 1 237 224 | | 9/2002 |
| EP | 1367671 | | 12/2003 |
| EP | 1367671 | A2 | 12/2003 |
| EP | 1258054 | | 8/2005 |
| ES | 2112163 | | 5/1995 |
| ES | 2112163 | | 11/1998 |
| ES | 2142280 | | 11/2000 |
| GB | 2317994 | | 4/1998 |
| GB | 2 361 584 | | 10/2001 |
| JP | 62-262502 | | 11/1987 |
| JP | 03156847 | | 1/1993 |
| JP | 05007109 | | 1/1993 |
| JP | 5-308223 | | 11/1993 |
| JP | 60-85530 | | 3/1994 |
| JP | H6-252629 | | 9/1994 |
| JP | 9-246852 | | 9/1997 |
| JP | 10-117108 | | 5/1998 |
| JP | 10-200327 | | 7/1998 |
| JP | 10247808 | | 9/1998 |
| JP | 10-303637 | | 11/1998 |
| JP | 11-004113 | | 1/1999 |
| JP | 11-27042 | | 1/1999 |
| JP | 11-220319 | | 8/1999 |
| JP | 2001-217632 | | 8/2001 |
| JP | 2001-251128 | | 9/2001 |
| JP | 2001332924 | | 11/2001 |
| JP | 2002050919 | | 2/2002 |
| JP | 2003-347835 | | 12/2003 |
| JP | 11-136015 | | 4/2005 |
| JP | H10-163748 | | 5/2010 |
| WO | 88/09065 | | 11/1988 |
| WO | 9629775 | | 9/1996 |
| WO | WO-96/38881 | | 12/1996 |
| WO | 97/06578 | | 2/1997 |
| WO | 9706578 | | 2/1997 |
| WO | 9735360 | | 9/1997 |
| WO | 98/05088 | | 2/1998 |
| WO | 98/20578 | | 5/1998 |
| WO | 9903166 | | 1/1999 |
| WO | 99/27608 | | 6/1999 |
| WO | 9927608 | | 6/1999 |
| WO | WO-99/56345 | | 11/1999 |
| WO | 99/65102 | | 12/1999 |
| WO | 99/67851 | A1 | 12/1999 |
| WO | 00/03451 | A1 | 1/2000 |
| WO | 00/36700 | | 6/2000 |
| WO | WO-00/77884 | | 12/2000 |
| WO | 0108257 | | 2/2001 |
| WO | WO-01/11721 | | 2/2001 |
| WO | 01/17063 | | 3/2001 |
| WO | 0122528 | | 3/2001 |
| WO | WO-01/26182 | | 4/2001 |
| WO | 01/31747 | A1 | 5/2001 |
| WO | 0133665 | | 5/2001 |
| WO | WO-01/48861 | | 7/2001 |
| WO | WO-01/54225 | | 7/2001 |
| WO | 01/56111 | | 8/2001 |
| WO | WO-02/35646 | | 5/2002 |
| WO | WO-0235652 | | 5/2002 |
| WO | 02078123 | A1 | 10/2002 |
| WO | 03034538 | A1 | 4/2003 |
| WO | 03034544 | A1 | 4/2003 |
| WO | 2004001894 | A1 | 12/2003 |
| WO | WO-2004/025778 | | 3/2004 |
| WO | 2004042868 | A1 | 5/2004 |
| WO | 2004057701 | A1 | 7/2004 |
| WO | WO-2005076409 | | 8/2005 |

OTHER PUBLICATIONS

Sauer, Joseph M. Response to the Office Action dated Oct. 4, 2004 for the U.S. Appl. No. 10/422,578; Jan. 6, 2005.

Wimer, Michael C. USPTO Office Action for U.S. Appl. No. 10/422,578; Apr. 7, 2005.

Sauer, Joseph M. Response to the Office Action dated Apr. 7, 2005 for the U.S. Appl. No. 10/422,578; May 31, 2005.

Wimer, Michael C. Advisory action before the filing of an appeal brief for U.S. Appl. No. 10/422,578; Jun. 23, 2005.

Sauer, J. Request for Continued Examination for U.S. Appl. No. 10/422,578; Aug. 8, 2005.

Wimer, Michael C. USPTO Office Action for U.S. Appl. No. 10/422,578; Aug. 24, 2005.

HTC Corp. Amended answer and counterclaim to plaintiff's amended complaint; Oct. 2, 2009.

Bhavsar, Samir, A. letter to Stanley R. Moore et al. re: *Fractus* v. *Samsung et al.*; Case No. 6:09-cv-00203-LED; Oct. 28, 2009.

Poulairikas , A., Handbook of antennas in wireless communications, Lal Chand Godara, 2002.

C. Puente et al., "Small But Long Koch Fractal Monopole", Electronics Letters, Jan. 8, 1998, vol. 34, No. 1, pp. 9-10.

Carles Puente Baliarda et al., "The Koch Monopole: A Small Fractal Antenna", IEEE Transactions on Antennas and Propagation, vol. 48, No. 11, Nov. 2000, pp. 1773-1781.

Nathan Cohen, "Fractal Antenna Applications in Wireless Telecommunications", IEEE, 1997, pp. 43-49.

C. Puente et al., "Multiband Properties of a Fractal Tree Antenna Generated by Electrochemical Deposition", Electronics Letters, Dec. 5, 1996, vol. 32, No. 25, pp. 2298-2299.

Sim, "An Internal Triple-band antenna for PCS/IMT-2000/Bluetooth Applications", IEEE Antennas and Wireless Propagation Letters, 2004, vol. 3.

Wong, Planar antennas for wireless communications, Wiley-Interscience, 2003.

Puente, Fractal antennas, Universitat Politècnica de Catalunya, 1997.

Puente, Multiband fractal antennas and arrays, Fractals engineering—from theory to industrial applications, 1994.

Nakano et al. Realization of dual-frequency and wide-band VSWR performances using normal-mode helical and inverted-F antennas, IEEE Transactions on Antennas and Propagation, 1998, vol. 46, No. 6.

Morishita et al., Design concept of antennas for small mobile terminals and the future perspective, IEEE Antennas and Propagation Magazine, 2002.

Dou et al, Small broadband stacked planar monopole, Willey Interscience, 2000.

Strugatsky, Multimode multiband antenna. Tactical communications: Technology in transition. Proceedings of the tactical communications conference, 1992.

Szkipala, Fractal antennas, TEAT, 2001.

Shnitkin, "Analysis of Log-Periodic Folded Dipole Array" (Sep. 1992).

Sinclair, "Theory of Models of Electromagnetic Systems," Proceedings of the IRE, Nov. 1948.

Snow, W. L., et al. "Ku-Band Planar Spiral Antenna," The Nineteenth Symposium on The USAF Antenna Research and Development Program, Oct. 14-16, 1969.

Snow, W. L., "UHF Crossed-Slot Antenna and Applications," The Thirteenth Symposium on The USAF Antenna Research and Development Program, Oct. 14-18, 1963.

Soler, J., Romeu, J., "Dual-band Sierpinski fractal monopole antenna," IEEE Antennas and Propagation Society International Symposium, 2000, vol. 3, pp. 1712-1715.
Song, C.T.P., Hall, P.T., Ghafouri-Shiraz, H. and Wake, D., "Fractal Stacked Monopole With Very Wide Bandwidth," Electronics Letters, 35, 12, Jun. 10, 1999.
Stang, Abstracts of the 12th Annual Symposium (Oct. 16-19, 1962).
Stang, Paul F., "Balanced Flush Mounted Log-Periodic Antenna for Aerospace Vehicles," Twelfth Annual Symposium on USAF Antenna Research and Development, vol. 1, Oct. 16-19, 1962.
Stutzman, "Antenna Theory and Design," 2nd ed., 1998.
Taga, Tokio and Tsunekawa, Kouichi, "Performance Analysis of a Built-In Planar Inverted F Antenna for 800 MHz Band Portable Radio Units," IEEE Journal on Selected Areas in Communications, vol. SAC-5, No. 5, Jun. 1987.
Tanner, Robert L., et al., "Electronic Counter Measure Antennas for a Modern Electronic Reconnaissance Aircraft," The Fourth Symposium on The USAF Antenna Research and Development Program, Oct. 17-21, 1954.
Teeter, W. L. and Bushore, K. R., "A Variable-Ratio Microwave Power Divider and Multiplexer," IRE Transactions on Microwave Theory and Techniques, 5, 4, Oct. 1957.
Teng, Pey-Ling and Wong, Kin-Lu, "Planar Monopole Folded Into a Compact Structure for Very Low-Profile Multiband Mobile-Phone Antenna," Microwave and Optical Technology Letters, vol. 33, No. 1. (Apr. 5, 2002).
Terman, F. E., Radio Engineering, New York, McGraw-Hill Book Company, 1947.
The Glen L. Martin Company, "Antennas for USAF B-57 Series Bombers" The Second Symposium on the USAF Antenna Research and Development Program, Oct. 19-23, 1952.
Turner and Richard, "Development of an Electrically Small Broadband Antenna," presented at the Eighteenth Symposium on The USAF Antenna Research and Development Program, Oct. 15-17, 1968.
Turner, "Broadband Passive Electrically Small Antennas for TV Application," presented at the Proceedings of the 1977 Antenna Applications Symposium on Apr. 27-29, 1977 at Robert Allerton Park at the University of Illinois.
Virga, "Low-Profile Enhanced Bandwidth PIFA Antennas for Wireless Communications Packaging," IEEE Transactions on Microwave Theory and Techniques, vol. 45, No. 10 (Oct. 1997).
Volakis, J., Antenna Engineering Handbook, pp. 39-7 to 39-15 (4th ed. 2007).
Walker, G.J. and James, J.R., "Fractal Volume Antennas," Electronics Letters, 34, 16, Aug. 6, 1998.
Wall, H. et al. "Communications Antennas for Mercury Space Capsule," The Eleventh Symposium on The USAF Antenna Research and Development Program, Oct. 16-20, 1961.
Watanbe, T., Furutani, K., Nakajima, N. and Mandai, H., "Antenna Switch Duplexer for Dualband Phone (GSM/DCS) Using LTCC Multilayer Technology," IEEE MTT-S International Microwave Symposium Digest, 1, Jun. 13-19, 1999.
Weeks, W. L., Antenna Engineering, New York, McGraw-Hill Book Company, 1968.
Weeks, W. L., Electromagnetic Theory for Engineering Applications, New York John Wiley & Sons, 1964.
Wegner, E. D., B-70 Antenna System, Thirteenth Annual Symposium on USAF Antenna Research and Development, 1963.
Wheeler, H.A., "The Radian Sphere Around a Small Antenna," IEEE Proc., vol. 47, pp. 1325-1331 (Aug. 1959).
Wheeler, H. A., "Fundamental Limitations of Small Antennas," Proceedings of the I.R.E. (Dec. 1947).
Wheeler, H.A., "Small Antennas," The Twenty-Third Symposium on the USAF Antenna Research and Development Program, Oct. 10-12, 1973.
Wong, K.-L. and Yang, K.-P., "Modified planar inverted F antenna," Electronics Letters, 34, 1, Jan. 8, 1998.
Wong, Kin-Lu and Sze, Jia-Yi, "Dual-Frequency Slotted Rectangular Microstrip Antenna," Electronics Letters, vol. 34, No. 14, Jul. 9, 1998.
Wong et al., "Broadband Microstrip Antennas With Integrated Reactive Loading," Microwave Conference, 1999 Asia Pacific, Nov. 1999, vol. 2, pp. 352-354.
McDowell, E. P., "High Speed Aircraft Antenna Problems and Some Specific Solutions for MX-1554," The Second Symposium on the USAF Antenna Research and Development Program, Oct. 19-23, 1952.
McDowell, E. P., "Flush Mounted X-Band Beacon Antennas for Aircraft," The Third Symposium on The USAF Antenna Research and Development Program, Oct. 18-22, 1953.
Parker, "Convoluted array elements and reduced size unit cells for frequency selective surfaces," IEE Proceedings-H, Antennas an Microwave Propagation, vol. 138, No. 1, Feb. 1991, p. 19-22.
Yang and Wang, "Compact Dual-Frequency Operation of Rectangular Microstrip Antennas," IEEE, pp. 1652-1655 (1999).
Adcock, M. D., "New Type Feed for High Speed Conical Scanning," The Second Symposium of the USAF Antenna Research and Development Program, Oct. 19-23, 1952.
Andersen, J. B., "Low- and Medium-Gain Microwave Antennas," in A. W. Rudge, K Milne, A. D. Olver, and P. Knight (eds.), The Handbook of Antenna Design, vols. 1 and 2, London, Peter Peregrinus Ltd., 1986.
Azadegan and Sarabandi, Design of Miniature Slot Antennas, IEEE Antennas and Propagation Society International Symposium, 2001 Digest, vol. 4 pp. 565-568 (Jul. 8, 2001).
Balanis, "Antenna Theory: Analysis and Design," John Wiley & Sons: 1997.
Barrick, William, "A Helical Resonator Antenna Diplexer," The Tenth Symposium on The USAF Antenna Research and Development Program, Oct. 3-7, 1960.
Batson, D. et al., "VHF Unfurlable Turnstile Antennas," The Nineteenth Symposium on The USAF Antenna Research and Development Program, Oct. 14-16, 1969.
Besthorn, J.W., "1.0-to 21.0-GHz Log-Periodic Dipole Antenna," presented at the Eighteenth Annual Symposium on The USAF Antenna Research and Development Program, Oct. 15-17, 1968.
Blackband, W. T., "Coaxial Transmission Lines and Components," in A. W. Rudge, K. Milne, A. D. Olver, and P. Knight (eds.), The Handbook of Antenna Design, vols. 1 and 2, London, Peter Peregrinus Ltd., 1986.
Bokhari, S.A., Zurcher, J.F., Mosig, J.R. and Gardiol, F. E., "A Small Microstrip Patch Antenna with a Convenient Tuning Option," IEEE Transactions on Antennas and Propagation, vol. 44, No. 11, Nov. 1996.
"Broadband Passive Electrically Small Antennas for TV Application," presented at the Proceedings of the 1977 Antenna Applications Symposium on Apr. 27-29, 1977 at Robert Allerton Park at the University of Illinois.
Brown, A. R. and Rebeiz, G. M. "A High-Performance Integrated K-Band Diplexer," IEEE Transactions on Microwave Theory and Techniques, 47, 8, Aug. 1999.
Burnett, G. F., "Antenna Installations on Super Constellation Airborne Early Warning and Control Aircraft," The Fourth Symposium on The USAF Antenna Research and Development Program, Oct. 17-21, 1954.
Bushman, F. W. et al., "The Boeing B-52 All Flush Antenna System," The Fifth Symposium on The USAF Antenna Research and Development Program, Oct. 16-20, 1955.
Campi, M., "Design of Microstrip Linear Array Antennas," 1981 Antenna Applications Symposium, Sep. 23-25, 1981.
Carver, Keith R. and Mink, James W., "Microstrip Antenna Technology," IEEE Transactions on Antennas and Propagation, AP-29, 1, Jan. 1981, pp. 2-24.
Chen, "Dual Frequency Microstrip Antenna with Embedded Reactive Loading," Microwave and Optical Technology Letters, vol. 23, No. 3, Nov. 5, 1999.
Chen, "Square-Ring Microstrip Antenna with a Cross Strip for Compact Circular Polarization Operation", IEEE Transactions on Antennas and Propagation, vol. 47, No. 10, Oct. 1999.
Chen, M. H., Tung, T. X. and Yodokawa, T. "A Compact EHF/SHF Dual Frequency Antenna," IEEE International Symposium on Antennas and Propagation Digest, 4, May 7-11, 1990.

Chiba, N., Amano, T. and Iwasaki, H., "Dual-Frequency Planar Antenna for Handsets," Electronics Letters, 34, 35, Dec. 10, 1998, pp. 2362-2363.
Cohen, "NEC4 Analysis of a Fractalized Monofilar Helix in an Axial Mode," Conference Proceedings vol. II for the 14th Annual Review of Progress in Applied Computational Electromagnetics at the Naval Postgraduate School in Montery, CA, Mar. 16-20, 1998.
Cohen, Nathan, "Fractal Element Antennas," Journal of Electronic Defense, Jul. 1997.
Cohn, S. B., "Flush Airborne Radar Antennas," The Third Symposium on The USAF Antenna Research and Development Program, Oct. 18-22, 1953.
Collier and Shnitkin, "Summary of the Monopole as a Wideband Array Antenna Element," presented at the 1993 Antenna Applications Symposium on Sep. 23, 1993.
Contreras, "Fractal Miniature Antenna" UPC Baix Llobregat Polytechnic University Project Research (Sep. 1997).
Daniel, Kumar, "Rectangular Microstrip Antennas with stub along the non-radiating edge for Dual Band Operation," IEEE Antennas and Propagation Society International Symposium 1995 Digest, vol. 4, p. 2136-2139.
Deschamps, G. et al., "Microstrip Microwave Antenna," The Third Symposium on The USAF Antenna Research and Development Program, Oct. 18-22, 1953.
Dickstein, Harold D., "Antenna System for a Ground Passive Electronic Reconnaissance Facility," The Eighth Symposium on The USAF Antenna Research and Development Program, Oct. 20-24, 1958.
DuHamel R. H. and Isbell, D. E., "Broadband Logarithmically Periodic Antenna Structures," IRE International Convention Record, 5, Part 1, Mar. 1957, pp. 119-128.
Du Plessis, "Tuning Stubs for Microstrip Patch Antennas," IEEE Antennas and Propagation Magazine, vol. 36, issue 6, pp. 52-56, 1993.
Dyson, J.D., "The Non-Planar Equiangular Spiral Antenna," The Eighth Symposium on The USAF Antenna Research and Development Program, Oct. 20-24, 1958.
Dyson, J.D., "The Equiangular Spiral Antenna," The Fifth Symposium on The USAF Antenna Research and Development Program, Oct. 16-20, 1955.
Ellis, A.R., "Airborne U-H-F Antenna Pattern Improvements," The Third Symposium on The USAF Antenna Research and Development Program, Oct. 18-22, 1953.
Esteban, J. and Rebollar, J. M., "Design and Optimization of a Compact Ka-Band Antenna Diplexer," IEEE International Symposium on Antennas and Propagation Digest, 1, Jun. 18-23, 1995, pp. 148-151.
ETSI, "Global System for Mobile Communications: Digital cellular telecommunications system (Phase 2); Mobile Station (MS) conformance specification; Conformance specification (GSM 11.10-1)," European Telecommunication Standard, Mar. 1996.
ETSI, "Global System for Mobile Communications: Digital cellular telecommunications system (Phase 2+); Abbreviations and acronyms (GSM 01.04)," GSM Technical Specification, Version 5.0.0, Mar. 1996.
ETSI, "Global System for Mobile Communications: Digital cellular telecommunications system (Phase 2); Types of Mobile Stations (MS) (GSM 02.06)," European Telecommunication Standard, 3rd ed., May 1996.
ETSI, "Global System for Mobile Communications: Digital cellular telecommunications system (Phase 2+); Radio transmission and reception (GSM 05.05)," GSM Technical Specification, Version 5.2.0, Jul. 1996.
ETSI, "Global System for Mobile Communications: Digital cellular telecommunications system (Phase 2); Mobile Station (MS) conformance specification; Part 1: Conformance specification (GSM 11.10-1 version 4.21.1)," European Telecommunication Standard, 8th ed., Aug. 1998.
Fenwick, R., "A New Class of Electrically Small Antennas," Presented at the Fourteenth Annual Symposium on USAF Antenna Research and Development, presented Oct. 6-8, 1964.
Ferris, J. E. et al., "A Status report of an Azimuth and Elevation Direction Finder" The Eighteenth Symposium on The USAF Antenna Research and Development Program, Oct. 15-17, 1968.
Force, R.D., et al. "Synthesis of Multilayer Walls for Radomes of Aerospace Vehicles," The Seventeenth Symposium on The USAF Antenna Research and Development Program, Nov. 14-17, 1967.
Photos of Fractus Panel 01 product (at least as early as 1998).
Photos of Fractus MSPK product (at least as early as 1998).
Gilbert, R., Structurally-Integrated Optically-Reconfigurable Antenna Array 1995 Antenna Applications Symposium, Sep. 20-22, 1995.
Gillespie, Edmond S., "Glide Slope Antenna in the Nose Radome of the F104A and B," The Seventh Symposium on The USAF Antenna Research and Development Program, Oct. 21-25, 1957.
Gray, "Electronically Steerable Yagi-Uda Microstrip Patch Antenna," IEEE Transactions on Antennas and Propagation, vol. 46, No. 5, May 1998.
Greiser, J. W. and Brown, G. S., "A 500:1 Scale Model of Warla—A Wide Aperture Radio Location Array," presented at the Thirteenth Symposium on The USAF Antenna Research and Development Program on Oct. 14-18, 1963 at the University of Illinois Antenna Laboratory in Urbana, Illinois.
Guo, Y.X. et al., "Double U-slot rectangular patch antenna," Electronics Letters, vol. 34, No. 19, pp. 1805-1806 (Sep. 17, 1998).
Gupta, K.C., "Broadbanding Techniques for Microstrip Patch Antennas—A Review," Antenna Applications Symposium, Sep. 21-23, 1988.
Gupta, Microstrip Antenna Design, Norwood, MA, Artech House 1988.
Ali, M. et al., "A Triple-Band Internal Antenna for Mobile Hand-held Terminals," IEEE, 2002.
Deng, A T-Strip Loaded Rectangular Microstrip Patch Antenna for Dual-Frequency Operation IEEE Antennas and Propagation Society International Symposium, Aug. 1999, vol. 2, pp. 940-943.
Hagstrom, P., "Novel Ceramic Antenna Filters for GSM/DECT and GSM/PCN Network Terminals," The 8th IEEE International Symposium on Personal, Indoor, and Mobile Radio Communications, vol. 3, Sep. 1-4, 1997.
Halloran, T.W. et al. "A Dual Channel VHF Telemetry Antenna System for Re-Entry Vehicle Applications," The Eleventh Symposium on The USAF Antenna Research and Development Program, Oct. 16-20, 1961.
Hikata, M., Shibagaki, N., Asai, K., Sakiyama, K. and Sumioka, A., "New Miniature SAW Antenna Duplexer Used in GHz-Band Digital Mobile Cellular Radios," 1995 IEEE Ultrasonics Symposium, 1, Nov. 7-10, 1995.
Hikita, M., Ishida, Y., Tabuchi, T. and Kurosawa, K., "Miniature SAW Antenna Duplexer for 800-MHz Portable Telephone Used in Cellular Radio Systems," IEEE Transactions on Microwave Theory and Techniques, 36, 6, Jun. 1988.
Hill, J.E. et al., "An Integrated Strip-Transmission-Line Antenna System for JBand," The Twenty-Third Symposium on The USAF Antenna Research and Development Program, Oct. 10-12, 1973.
Hofer, D.A., Kesler, O.B., and Loyet, L.L., "A Compact Multi-Polarized Broadband Antenna," Proceedings of the 1989 Antenna Applications Symposium, Sep. 20-22, 1989.
Holtum, A. G., "A Dual Frequency Dual Polarized Microwave Antenna," The Sixteenth Symposium on The USAF Antenna Research and Development Program, Oct. 11-13, 1966.
Holzschuh, D.L., "Hardened Antennas for Atlas and Titan Missile Site Communications," The Thirteenth Symposium on The USAF Antenna Research and Development Program, Oct. 14-18, 1963.
Hong, "Compact microwave elliptic function filter using novel microstrip meander open-loop resonators" (Mar. 14, 1996).
Hong and Lancaster, Recent Advances in Microstrip Filters for Communications and Other Applications, IEEE, pp. 2/1-2/6 (1997).
Huynh, T. and Lee, K.F., "Single-layer single-patch wideband microstrip antenna," Electronics Letters, 31, 16, Aug. 3, 1995.
Hyneman, R.F., et al., "Homing Antennas for Aircraft (450-2500 MC)," The Fifth Symposium on The USAF Antenna Research and Development Program, Oct. 16-20, 1955.
IEEE, IEEE Standard Definitions of Terms for Antennas, IEEE Std. 145-1983, New York, IEEE, 1983.
Ikata, O., Satoh, Y., Uchishiba, H., Taniguchi, H., Hirasawa, N., Hashimoto, K. and Ohmori, H., "Development of Small Antenna Duplexer Using SAW Filters for Handheld Phones," 1993 IEEE Ultrasonics Symposium, 1, Oct. 31-Nov. 3, 1993.
Ingerson, Paul G. and Mayes, Paul E., "Asymmetrical Feeders for Log-Periodic Antennas," The Seventeenth Symposium On The USAF Antenna Research and Development Program (Nov. 14-17, 1967).
Isbell, D.E., "Non-Planar Logarithmically Periodic Antenna Structures," Seventh Annual Symposium on USAF Antenna Research and Development Program, Oct. 21-25, 1957.
Isbell, D.E., "Multiple Terminal Log-Periodic Antennas," Eighth Annual Symposium on The USAF Antenna Research and Development Program, Oct. 20-24, 1958.
Ishikawa, Y., Hattori, J., Andoh, M. and Nishikawa, T., "800 MHz High Power Bandpass Filter Using TM Dual Mode Dielectric Resonators," 21st European Microwave Conference, vol. 2, Sep. 9-12, 1991.
James and Hall, "Handbook of Microstrip Antennas", vol. 1, 1989.
Jones, Howard S., "Conformal and Small Antenna Designs," Proceedings of the 1981 Antenna Applications Symposium, Aug. 1981.
Kraus, John D., Antennas, Second Edition, New York, McGraw-Hill Book Company, 1988.
Kuhlman, E.A., "A Directional Flush Mounted UHF Communications Antenna for High Performance Jet Aircraft for the 225-400 MC Frequency Range," The Fifth Symposium on The USAF Antenna Research and Development Program, Oct. 16-20, 1955.
Kumar, G. and Gupta, K., "Directly Coupled Multiple Resonator Wide-Band Microstrip Antennas," IEEE Transactions on Antennas and Propagation, AP-29, 1, Jun. 1985, pp. 588-593.
Kumar, "Nonradiating Edges and Four Edges Gap-Coupled Multiple Resonator Broad-Band Microstrip Antenna," IEEE Transactions on Antenna and Propagation, Feb. 1985.
Kuo, Sam, "Frequency-Independent Log-Periodic Antenna Arrays With Increased Directivity and Gain," Twenty-First Annual Symposium on USAF Antenna Research and Development, Oct. 12-14, 1971.
Kurpis, G. P., The New IEEE Standard Dictionary of Electrical and Electronics Terms, Fifth Edition, New York, IEEE, 1993.
Kutter, "Fractal Antenna Design" (Honors Thesis, University of Dayton, 1996).
Lancaster, et al., "Miniature Superconducting Filters" IEEE Transactions on Microwave Theory and Techniques (Jul. 1996).
Larson, III, J. D., Ruby, R., Bradley, P. and Oshmyansky, Y., "A BAW Antenna Duplexer for the 1900 MHz PCS Band," 1999 IEEE Ultrasonics Symposium, 2, Oct. 17-20, 1999.
Lee, J.C., "Analysis of Differential Line Length Diplexers and Long-Stub Filters," The Twenty-First Symposium on The USAF Antenna Research and Development Program, Oct. 12-14, 1971.
Liu, "Dual-Frequency Planar Inverted-F Antenna," IEEE Transactions on Antennas and Propagation, vol. 45, No. 10, Oct. 1997.
D. Liu, "A Multi-branch monopole antenna for dual-band cellular applications," IEEE Antennas and Propagation society international symposium and URSI Radio science Meeting proceedings, vol. 3, pp. 1578-1581, Jul. 11-16, 1999, USA.
Lo, Y. T., et al. "Theory and Experiment on Microstrip Antennas," 1978 Antenna Applications Symposium, Sep. 20-22, 1978.
Locus, Stanley S., "Antenna Design for High Performance Missile Environment," The Fifth Symposium on The USAF Antenna Research and Development Program, Oct. 16-20, 1955.
Lu, Jui-Han & Wong, Kin-Lu, "Dual-Frequency Rectangular Microstrip Antenna with Embedded Spur Lines and Integrated Reactive Loading," Microwave & Optical Tech. Letters, 21, 4, May 20, 1999.
Lu and Wong, "Slot-loaded, meandered rectangular microstrip antenna with compact dual-frequency operation," Electronics Letters, vol. 34, No. 11, May 28, 1998.
Lu and Wong, "Single-feed dual-frequency equilateral-triangular microstrip antenna with pair of spur lines," Electronics Letters, vol. 34, No. 12, Jun. 11, 1998.
Lu, "Single-Feed Dual-Frequency Rectangular Microstrip Antenna," IEEE Antennas and Propagation Society International Symposium, 2000, vol. 4, pp. 2192-2195.
Lu et al., "Novel Dual-Frequency and Broad-Band Designs of Slot-Loaded Equilateral Triangular Microstrip Antennas," Microwave and Optical Technology Letters, vol. 48, No. 7 (Jul. 2000).
Maci, S. and Gentili, G. B., "Dual-Frequency Patch Antennas," IEEE Antennas and Propagation Magazine, 39, 6, Dec. 1997.
Maci et al., "Dual-band Slot-loaded patch antenna", IEE Proc.-Microw. Antennas Propag., vol. 142, No. 3, pp. 225-232 (Jun. 1995).
Manteuffel, D. et al., Design Considerations for Integrated Mobile Phone Antennas, 11th Int'l Conference on Antennas & Propagation, Conference Publication No. 480, pp. 252-256 (Apr. 17-20, 2001).
Martin, W.R., "Flush VOR Antenna for C-121C Aircraft," The Second Symposium on The USAF Antenna Research and Development Program, Oct. 19-23, 1952.
Martin, R.W., et al. "An Unfurlable, High-Gain Log-Periodic Antenna for Space Use" The Seventeenth Symposium on The USAF Antenna Research and Development Program, Nov. 14-17, 1967.
May, "Aerial Magic," New Scientist, pp. 28-30 (Jan. 31, 1998).
Mayes, P.E., et al. "Multi-Arm Logarithmic Spiral Antennas," The Tenth Symposium on The USAF Antenna Research and Development Program, Oct. 3-7, 1960.
Mayes, P.E., et al. "High Gain Log-Periodic Antennas," The Tenth Symposium on The USAF Antenna Research and Development Program, Oct. 3-7, 1960.
Mayes, P., et al. "Some Broadband, Low-Profile Antennas," 1985 Antenna Applications Symposium, Sep. 18-20, 1985.
McSpadden, J. O., Lu, Fan and Chang, Kai, "Design and Experiments of a High-Conversion-Efficiency 5.8-GHz Rectenna," IEEE Transactions on Microwave Theory and Techniques, 46, 12, part 1, Dec. 1998.
Misra and Chowdhury, "Study of Impedance and Radiation Properties of a Concentric Microstrip Triangular-Ring Antenna and Its Modeling Techniques Using FDTD Method," IEEE Transactions on Antennas and Propagation, vol. 46, No. 4, Apr. 1998.
Misra, Ita et al., "Experimental Investigations on the Impedance and Radiation Properties of a Three-Element Concentric Microstrip Antenna," Microwave and Optical Technology Letters, vol. 11, No. 2, Feb. 5, 1996.
Moheb, H., Robinson, C. and Kijesky, J., "Design & Development of Co-Polarized Ku-Band Ground Terminal System for Very Small Aperture Terminal (VSAT) Application," IEEE International Symposium on Antennas and Propagation Digest, 3, Jul. 11-16, 1999.
Munson, R. et al. "Conformal Microstrip Array for a Parabolic Dish," The Twenty-Third Symposium on The USAF Antenna Research and Development Program, Oct. 10-12, 1973.
Munson, R., "Microstrip Phased Array Antennas," The Twenty-Second Symposium on The USAF Antenna Research and Development Program, Oct. 11-13, 1972.
Munson, R. E., "Conformal Microstrip Antennas and Microstrip Phased Arrays," IEEE Trans. Antennas Propagat., vol. Ap-22, p. 74, Jan. 1974.
Mushiake, Yasuto, Self-Complementary Antennas: Principle of Self-Complementarity for Constant Impedance, London, Springer-Verlag London Limited, 1996.
Nadan, T. Le, Coupez, J. P., Toutain, S. and Person, C., "Integration of an Antenna/Filter Device, Using a Multi-Layer, Multi-Technology Process," 28th European Microwave Conference, vol. 1, Oct. 1998.
Nagai, Kiyoshi, Mikuni, Yoshihiko and Iwasaki, Hisao, "A Mobile Radio Antenna System Having a Self-Diplexing Function," IEEE Transactions on Vehicular Technology, 28, 4, Nov. 1979.
Nakano and Vichien, "Dual-Frequency Square Patch Antenna with Rectangular Notch," Electronics Letters, vol. 25 No. 16, Aug. 3, 1989.
Nishikawa, T., Ishikawa, Y., Hattori, J. and Wakino, K. "Dielectric Receiving Filter with Sharp Stopband Using an Active Feedback Resonator Method for Cellular Base Stations," IEEE Transactions on Microwave Theory and Techniques, 37, 12, Dec. 1989.
Photos of Nokia 3210 product (1999 or earlier).
Photos of Nokia 8210 product (1999 or earlier).
Photos of Nokia 8260 product (1999 or earlier).
Photos of Nokia 8265 product (1999 or earlier).
Photos of Nokia 8810 product (1998 or earlier).
Photos of Nokia 8850 product (1999 or earlier).
Photos of Nokia 8860 product (1999 or earlier).

Omar et al., "A New Broad-band Dual-Frequency Coplanar Waveguide Fed Slot-Antenna," IEEE, 1999.
Ou, J. D. et al., "An Analysis of Annular, Annular Sector, and Circular Sector Microstrip Antennas," 1981 Antenna Applications Symposium, Sep. 23-25, 1981.
Pan, S. and Hsu, W., "Single-Feed Dual-Frequency Microstrip Antenna with Two Patches," IEEE, 1999.
Paschen, D.A. & Mayes, P.E., "Structural Stropband Elimination with the Monopole-Slot Antenna," 1982 Antenna Applications Symposium, Sep. 22-24, 1982.
Paschen, D.A., "Broadband Microstrip Matching Techniques," 1983 Antenna Applications Symposium, Sep. 21-23, 1983.
Phelan, H.R., "A Wide-Band Parallel-Connected Balun," The Eighteenth Symposium on The USAF Antenna Research and Development Program, Oct. 15-17, 1968.
Pozar, David M., Microwave Engineering, Reading, MA, Addison-Wesley, 1990.
Pribetich, "QuasiFractal Planar Microstrip Resonators for Microwave Circuits," Microwave and Optical Technology Letters, vol. 21, No. 6 (Jun. 20, 1999).
Puente, C., Romeu, J., Pous, R., Garcia, X. and Benitez, F., "Fractal Multiband Antenna Based on the Sierpinski Gasket," Electronics Letters, 32, 1, Jan. 4, 1996.
Puente, C., Romeu, J., Bartoleme, R. and Pous, R., "Perturbation of the Sierpinski Antenna to Allocate Operating Bands," Electronics Letters, 32, 24, Nov. 21, 1996.
Puente-Baliarda, "On the Behavior of the Sierpinski Multiband Fractal Antenna," IEEE Transactions on Antennas and Propagation, vol. 46, No. 4 (Apr. 1998).
Rensh, "Broadband Microstrip Antenna," Proceedings of the Moscow International Conference on Antenna Theory and Tech. 1998, vol. 28, pp. 420-423 (Sep. 22, 1998).
Photos of RIM 857 product (at least as early as 2000) and SAR report from FCC.
Photos of RIM 957 product (at least as early as 2000).
Rockwell B-1B Lancer <http://home.att.net/~jbaugher2/newb1_2.html> (last visited Feb. 17, 2010).
Rosa, J. et al., "A Wide Angle Circularly Polarized Omnidirectional Array Antenna," The Eighteenth Symposium on The USAF Antenna Research and Development Program, Oct. 15-17, 1968.
Rotman, W., "Problems Encountered in the Design of Flush-Mounted Antennas for High Speed Aircraft," The Second Symposium on the USAF Antenna Research and Development Program, Oct. 19-23, 1952.
Rowell and Murch, "A Compact PIFA Suitable for Dual-Frequency 900/1800-MHz Operation," IEEE Transactions on Antennas and Propagation, vol. 46, No. 4, Apr. 1998.
Rowell, "A Capacitating Loaded PIFA for Compact Mobile Telephone Handsets," IEEE Transactions on Antennas and Propagation, 45, 5, May 1997.
Rudge, A. W., Milne, K., Olver, A. D. and Knight P., (eds.), The Handbook of Antenna Design, vols. 1 and 2, London, Peter Peregrinus Ltd., 1986.
Rumsey, Victory H., Frequency Independent Antennas, New York, Academic Press, 1966. Stang, Abstracts of the 12th Annual Symposium (Oct. 16-19, 1962).
Sanchez-Hernandez, D. & Robertson, I. D., "Analysis and Design of a Dual-Band Circularly Polarized Microstrip Patch Antenna," IEEE Transactions on Antennas and Propagation, 43, 2, Feb. 1995. The Glen L. Martin Company, "Antennas for USAF B-57 Series Bombers" The Second Symposium on The USAF Antenna Research and Development Program, Oct. 19-23, 1952.
Sandlin, B.S., Terzuoli, A.J., "A Genetic Antenna Design for Improved Radiation Over Earth," Program for 1997 Antenna Applications Symposium (Allerton Conference Proceedings), Sep. 17-18, 1997.
Saunders, Simon R., Antennas and Propagation for Wireless Communication Systems, Chichester, John Wiley & Sons, Ltd., 1999.
Scharfman, W., et al. "Telemetry Antennas for High-Altitude Missiles," The Eighth Symposium on The USAF Antenna Research and Development Program, Oct. 20-24, 1958.
Schaubert, Chang and Wunsch, "Measurement of Phased Array Performance at Arbitrary Scan Angles," presented at the 1994 Antenna Applications Symposium on Sep. 21, 1994.
Seavy, J. et al., "C-Band Paste-On and Floating Ring Reflector Antennas," The Twenty-Third Symposium on The USAF Antenna Research and Development Program, Oct. 10-12, 1973.
Shenoy, A., Chalmers, H., Carpenter, E., Bonetti, R. and Wong, A., "Notebook Satcom Terminal Technology Development," Tenth International Conference on Digital Satellite Communications, May 15-19, 1995.
Shibagaki, N. Sakiyama, K. and Hikita, M., "SAW Antenna Duplexer Module Using SAW-Resonator-Coupled Filter for PCN System," 1998 IEEE Ultrasonics Symposium, 1, Oct. 5-8, 1998.
Shibagaki, N., Sakiyama, K. and Hikita, M. "Miniature SAW Antenna Duplexer Module for 1.9 GHz PCN Systems Using SAW-Resonator-Coupled Filters," 1998 IEEE Ultrasonics Symposium, 2, Jun. 7-12, 1998.
Shimoda, R.Y., "A Variable Impedance Ratio Printed Circuit Balun," 1979 Antenna Applications Symposium, Sep. 26-18, 1979.
Office Action for European patent application 00909089.5, Feb. 7, 2003.
Response to Office Action dated on Feb. 7, 2003 for European patent application 00909089.5; Aug. 14, 2003.
Summons to Attend Oral Proceedings for European patent 00909089.5, Oct. 28, 2004.
Written Submissions for European patent 00909089.5, Dec. 12, 2004.
Minutes of oral proceedings (including annexes) for European patent 00909089.5, Jan. 28, 2005.
Response to Office Action dated on Nov. 5, 2004 for the Chinese patent application 00818542.5, Mar. 31, 2005.
Office Action for US patent application 7312762, Oct. 5, 2006.
Response to Office Action dated on Dec. 27, 2006 for US patent application 7312762, Jan. 4, 2007.
Addison, Paul S. Fractals and Chaos : An Illustrated Course, Institute of Physics Publishing, Bristol and Philadelphia; IOP Publishing 1997, pp. 30, 31 & 33.
Balanis, Constantine A. Antenna Theory, John Wiley & Sons, Inc., 1982.
Berizzi, Fabrizio et al., Fractal Analysis of the Signal Scattered from the Sea Surface, IEEE Transactions on Antennas and Propagation, vol. 47, No. 2, Feb. 1999, pp. 324-338.
Boshoff, Hendrik F'v. A Fast Box Counting Algorithm for Determining the Fractal Dimension of Sampled Continuous Functions, 1992 IEEE, pp. 43-48.
Carver, Keith R. et al., Microstrip Antenna Technology IEEE Transactions on Antennas and Propagation, vol. AP-29, No. 1, Jan. 1981, pp. 2-23.
Chen, Susan S. et al., On the Calculation of Fractal Features from Images. IEEE Transactions on Pattern Analysis and Machine Intelligence, vol. 15, No. 10, Oct. 1993, pp. 1087-1090.
Falconer, Kenneth, Fractal Geometry : Mathematical Foundations and Applications. 2nd edition, John Wiley & Sons. Ltd., 2003.
Feng, Jie et al., Fractional Box-Counting Approach to Fractal Dimension Estimation, IEEE 1996; Proceedings of ICPR'96, pp. 854-858.
Garg, Ramesh et al., Microstrip Antenna Design Handbook, 2001, Artech House, Inc.
Hansen, RC Fundamental limitation in antennas, Proceedings of the IEEE, Feb. 1981.
Munson, R. E. Microstrip Antennas in Johnson, Richard C. (Editor), Antenna Engineering Handbook, McGraw Hill Inc., 1993.
Kobayashi, S. et al., Estimation of 3D Fractal Dimension of Real Electrical Tree Patterns. IEEE 1994; Proceedings of the 4th International Conference on Properties and Applications of Dielectric Materials, Jul. 3-8, 1994, Brisbane, Australia, pp. 359-362.
Kraus, John O. Antennas, 1988, McGraw-Hili, Inc., preface and list of contents.
Neary David: Fractal methods in Image Analysis and Coding, Thesis, Dublin City University—School of Electronic Engineering, Dublin 9, Ireland, Sep. 20, 2000, (Internet: http://www.redbrick.dcu.ie/~bolsh/thesis/).
Ng, Vincent et al., Diagnosis of Melanoma with Fractal Dimensions IEEE TENCON, 1993/ Beijing, pp. 514-517.

Peitgen, Heinz-Otto et al., Chaos and Fractals—New Frontiers of Science ,1992, pp. 212-216, 387-388.
Penn, Alan I. et al., Fractal Dimension of Low-Resolution Medical Images. 18th Annual International Conference of the IEEE Engineering in Medicine and Biology Society, Amsterdam 1996; 4.5.3: Image Pattern Analysis. pp. 1163-1165.
Pozar, David M. et al., Microstrip Antennas—The Analysis and Design of Microstrip Antennas and Arrays, 1995, Institute of Electrical and Electronic Engineers, Inc, p. ix and 3.
Puente, J. Anguera, J. Romeu, C. Borja, M. Navarro and J. Soler, Fractal-Shaped Antennas and their Application to GSM 900/1800, AP2000 Millenium Conference on Antennas and Propagation, Davos, Apr. 2000.
Rouvier, S. et al. Fractal Análisis of Bidimensional Profiles and Application to Electromagnetic Scattering from Soils. 1996 IEEE, pp. 2167-2169.
Russell D.A.; Hanson J.D.; Ott E.: Dimension of strange attractors. Physical Review Letters vol. 45, No. 14, Oct. 6, 1980, USA, pp. 1175-1178.
Sarkar, Nirupam et al., An Efficient Differential Box-Counting Approach to Compute Fractal Dimension of Image. IEEE Transactions on Systems, Man and Cybernetics, vol. 24, No. 1, Jan. 1994, pp. 115-120.
So P.; Barreto E.B.; Hunt B.R.: Box-counting dimension without boxes: Computing D0 from average expansion rates, Physical Review E vol. 60, No. 1, Jul. 1999, USA, pp. 378-385.
Software to compute box-counting dimension (Internet: http://www.sewanee.edu/physics/PHYSICS123/BOX%20COUNTING%20DIMENSION.html).
Tang, Y, et al., The Application of Fractal Analysis to Feature Extraction, IEEE, 1999, pp. 875-879.
European Search Report of patent application No. 10180818 dated Dec. 12, 2010. European Patent Office-EPO.
Teng, P. L. ; Wong , K. L. , Planar monopole folded into a compact structure for very-low-profile multiband mobile-phone antenna, Microwave and optical technology letters, Apr. 5, 2002.
*Downunder Wireless LLC*, Plaintiff, v. *HTC Corp; LG Electronics; Motorola Inc.; Nokia Corp.; Pantech Wireless Inc.; Personal Communications Devices LLC; Sharp Electronics Corp; and Sony Ericsson Mobile Communications (USA) Inc.*, Defendants. Civil action No. 2:09-cv-206. Jury trial requested. Filed Jun. 29, 2009.
Antenna Installation on Super Constellation Airborne Early Warning and Control Aircraft, Allerton Conference, 1954.
Blackband, W. T., Coaxial Transmission Lines and Components, in A. W. Rudge, K. Milne, A. D. Olver, and P. Knight (eds.), The Handbook of Antenna Design, vols. 1 and 2, London, Peter Peregrinus Ltd., 1986.
Counter, V. A., Flush, Re-entrant, Impedance Phased, Circularly Polarized Cavity Antenna for Missiles. The Second Symposium on the USAF Antenna Research and Development Program, Oct. 19-23, 1952.
Counter and Margerum. Flush Dielectric Disc Antenna for Radar, AllertonConference, 1952.
FCC Form 731 filed Apr. 1, 1999.
GSM Technical Specification and related materials, ETSI, 1996.
Photos of Hagenuk Global Handy (at least as early as 1996).
Photos of Motorola Advisor Elite (1997).
Photos of Motorola Advisor Gold (1996).
Photos of Motorola Bravo Plus (1995).
Photos of Motorola P935 product (1997).
Photos of Motorola Page Writer 2000x (1997).
Photos of Nokia 3360 (1999 or earlier).
Photos of RIM950 product (at least as early as 1998).
Jäschke , H. ; Ribbe , J. ; Von Walter , S. Summons to attend oral proceedings in connection with the European patent application No. 02808265.9 dated on Jun. 25, 2010. European Patent Office—EPO, 2010.
Carpintero , F. Response to the summons to attend oral proceedings of European patent application No. 02808256.9 dated on Oct. 21, 2010. Herrero & Asociados, 2010.
Mithani , S. Amendment in response to non-final office action dated Aug. 23, 2006 of U.S. Appl. No. 11/124,768.
Mithani , S. Amendment in response to non-final office action dated Feb. 6, 2008 of U.S. Appl. No. 11/713,324.
Mithani , S. Amendment in response to non-final office action dated Oct. 1, 2008 of U.S. Appl. No. 12/055,748.
Mithani , S. Amendment in response to non-final office action dated on Dec. 28, 2007 of U.S. Appl. No. 11/124,768.
Mithani , S. Amendment in response to the office action dated Feb. 21, 2007 for U.S. Appl. No. 11/124,768.
Ho, Tan. Notice of Allowance of U.S. Appl. No. 11/124,768 dated Aug. 29, 2007. USPTO.
Ho, Tan. Notice of Allowance of U.S. Appl. No. 11/124,768 dated on Apr. 7, 2008. USPTO.
Ho, Tan. Notice of Allowance of U.S. Appl. No. 11/124,768 dated on May 18, 2006. USPTO.
Ho, Tan. Notice of Allowance of U.S. Appl. No. 11/713,324 dated on May 14, 2008. USPTO.
Ho, Tan. Notice of Allowance of U.S. Appl. No. 12/055,748 dated Nov. 20, 2009. USPTO.
Ho, Tan. Notice of Allowance of U.S. Appl. No. 12/055,748 dated Aug. 12, 2009. USPTO.
Ho, Tan. Office Action of U.S. Appl. No. 11/124,768 dated on Aug. 23, 2006. USPTO.
Ho, Tan. Office Action of U.S. Appl. No. 11/124,768 dated on Dec. 28, 2007. USPTO.
Ho, Tan. Office Action of U.S. Appl. No. 11/124,768 dated on Feb. 21, 2007. USPTO.
Ho, Tan. Office Action of U.S. Appl. No. 11/713,324 dated on Feb. 6, 2008. USPTO.
Ho, Tan. Office Action of U.S. Appl. No. 12/055,748 dated on May 28, 2009. USPTO.
Ho, Tan. Office Action of U.S. Appl. No. 12/055,748 dated on Oct. 1, 2008. USPTO.
Ho, Tan. Office Action of U.S. Appl. No. 12/652,794 dated on Jun. 23, 2010. USPTO.
Mithani , S. Response to the Office Action dated May 28, 2009 of U.S. Appl. No. 12/055,748. USPTO.
Document 415—P.R. 4-3 joint claim construction statement, dated Jun. 14, 2010.
Document 429—Declaration of Jeffery D. Baxter—Including Exhibits: J, K, L, M ,N ,O, P, Q, R, S, T, U, Z, AA, KK, LL, dated Jul. 30, 2010.
Document 452—Defendant's reply in support of their motion for summary judgment of invalidity based on indefiniteness and lack of written description for certain terms with exhibits WW, BBB, EEE, GGG, HHH, III, KKK, MMM, NNN, OOO, PPP, Q, dated Aug. 30, 2010.
Document 641—Defendant HTC America, Inc's second amended answer and counterclaim to plaintiff's second amended complaint, dated Feb. 25, 2011.
Document 642—Defendant HTC Corporation's second amended answer and counterclaim to plaintiff's second amended complaint, dated Feb. 25, 2011.
Document 889—Reply in support of defendants' motion to clarify claim construction, dated Apr. 27, 2011.
Document 893—Fractus SA's surreply to defendant's motion to clarify claim construction, Apr. 29, 2011.
Document 900—Order, dated Apr. 29, 2011.
Document 901—Report and recommendation of United States Magistrate Judge, dated May 2, 2011.
Document 902—Fractus SA's objections to defendants' prior art notice, dated May 2, 2011.
Document 915—Defendants' response to plaintiff's objections to defendants notice of prior art, dated May 5, 2011.
Document 933—Defendants' motion for reconsideration of, and objections to, the May 2, 2011 report and recommendation clarifying claim construction, dated May 9, 2011.
Document 939—Fractus's response to defendants' motion for reconsideration of and objections to the May 2, 2011, report and recommendations clarifying claim construction, dated May 10, 2011.
Document 968—Order, dated May 13, 2011.
Document 971—Order, dated May 13, 2011.
Internal Photos—FCC ID: GMLNPW-3 , Federal Communications Commission , Dec. 19, 2001.

Declaration of Jeffery D. Baxter—Including Exhibits regarding US patent 7411556 Defendants 20100730.
Dubost , G. Wideband flat dipole and short-circuit microstrip patch elements and arrays. In Handbook of microstrip antennas—Chapter 7. Peter Peregrinus Ltd. James, J. R.; Hall, P. S. (ed.) 1989.
NA. Nokia 8260—FCC ID GMLNSW-4DX. Apr. 1999.
Rudge, A. W. The handbook of antenna design. Peter Peregrinus, 1986.
Borja , C.; Puente, C. Iterative network models to predict the performance of Sierpinski fractal antennas and networks. Antennas and Propagation Society International Symposium, 1999.
Campos, O. Study of multiband and miniature fractal antennas. Universitat Politècnica de Catalunya, 1998.
Cristal , E. G. et al. Hairpin-line and hybrid hairpin-line/Half-wave parallel-coupled-line filers. IEEE Transactions on Microwave Theory and Techniques. Nov. 1972.
Hohlfeld , R. G.; Cohen N. Self-similarity and the geometric requirements for frequency independence in antennae. Fractals, 1999.
Jaggard , D. L. Fractal electrodynamics and modeling. Directions in electromagnetic wave modeling, 1991.
Lee , B. T. Office action for the U.S. Appl. No. 10/181,790 dated Aug. 27, 2004.
Lee , B. T. Office action for the U.S. Appl. No. 10/181,790 dated Jun. 2, 2005.
Lee , B. T. Response to office action for the U.S. Appl. No. 10/181,790 dated Aug. 27, 2004.
Lee , B.T. Office action for the U.S. Appl. No. 10/181,790 dated Mar. 2, 2005.
Lee , Benny T. Office action for the U.S. Appl. No. 10/181,790 dated Aug. 4, 2005.
Maiorana , D. Amendment and response to the Office Action dated Jan. 23, 2004 of U.S. Appl. No. 10/102,568.
Mandelbrot, B. The fractal geometry of nature. Freeman and Company. 1983.
Matthaei, George L. et al. Hairpin-comb filters for HTS and other narrow-band applications. IEEE Transactions on Microwave Theory and Techniques, Aug. 1997.
Matthaei, George L. Microwave filters impedance-matching networks and coupling structures. Artech House. 1980.
Mithani, S. Response to the Office Action dated Mar. 12, 2007 of U.S. Appl. No. 11/021,597.
NA. International preliminary examination report of PCT/EP00/00411. European Patent Office (EPO). Aug. 2002.
NA. Nokia 8290. 2010.
NA. Office action for the Chinese patent application 01823716 dated Feb. 16, 2007.
NA. Office action for the Chinese patent application 01823716 dated Sep. 21, 2007.
NA. Response to the office action dated Feb. 16, 2007 for the Chinese patent application 01823716.
Nguyen, H. Notice of Allowance of U.S. Appl. No. 12/347,462 dated May 18, 2009.
Nguyen, H. Office Action of U.S. Appl. No. 12/347,462 dated Oct. 28, 2009.
Nguyen, H. Office Action of U.S. Appl. No. 10/182,635 dated Dec. 13, 2004.
Nguyen, H. Notice of Allowance of U.S. Appl. No. 11/110,052 dated May 30, 2006.
Peitgen, H.; Jurgens, H.; Saupe, D. Chaos and Fractals: New frontiers of Science—p. 8-9.
Rolan Cisneros, E. International Search Report for the PCT patent application ES99/00296. OEPM. Mar. 2001.
Sauer, J. Amendment and response to office action dated Dec. 13, 2004 of U.S. Appl. No. 10/182,635.
Sauer, J. Amendment and response to office action dated Oct. 4, 2004 of U.S. Appl. No. 10/182,635.
Sauer, J. M. Response to the office action from U.S. Appl. No. 10/181,790 dated Mar. 2, 2005.
Sauer, J. M. Response to the Office Action mailed Jan. 26, 2006 and Advisory Action mailed Mar. 29, 2006 for the U.S. Appl. No. 10/422,578.
Sauer, J.M. Response to the office action from U.S. Appl. No. 10/181,790 dated Jun. 2, 2005.
Soler, J.; Romeu, J.; Puente, C. Mod-P Sierpinski fractal multiband antenna. Antennas and Propagation Society International Symposium, 2000.
Tinker J. A. Response to the office action dated Oct. 30, 2007 of U.S. Appl. No. 11/021,597.
Wimer, M. C. Office Action for the U.S. Appl. No. 10/422,578 dated Aug. 23, 2007.
Wimer, M. C. Office Action for the U.S. Appl. No. 10/422,578 dated Jan. 26, 2006.
Wimer, M. C. Office Action for the U.S. Appl. No. 10/422,578 dated Mar. 12, 2007.
Wimer, M. C. Office action for the U.S. Appl. No. 10/422,578 dated Mar. 26, 2008.
Wimer, M. C. Office Action for the U.S. Appl. No. 11/021,597 dated Mar. 12, 2007.
Wimer, M. C. Office Action for U.S. Appl. No. 10/422,578 dated Jun. 23, 2005.
Wimer, M. Office action of U.S. Appl. No. 11/021,597 dated Oct. 30, 2007.
Zhang, Dawei; Liang, G.C.; Shih, C.F. Narrowband lumped element microstrip filters using capacitively loaded inductors. Microwave Symposium Digest, 1995.
Defendants LG Electronics Mobilecomm USA., Inc.'s answer and counterclaim to complaint. LG Electronics Mobilecomm USA., Inc. Jan. 10, 2010.
Defendant Pantech Wireless, INC.'S answer, affirmative defenses and counterclaims to Fractus SA's Amended complaint. Pantech Wireless, Inc. Jun. 4, 2009.
Defendant UTStarcom, Inc.'s answer, affirmative defenses, and counterclaims to plaintiff's amended complaint. UTStarcom, Inc. Jun. 8, 2009.
Answer, affirmative defenses and counterclaims to the amended complaint for patent infringement on behalf of Defendant Personal Communications Devices Holdings, LLC. Jul. 20, 2009.
Defendant Sanyo North America Corporation's partial answer to amended complaint for patent infringement. Sanyo North America Corporation. Jul. 20, 2009.
Kyocera Communications Inc's answer, affirmative defenses and counterclaims to plantiff's amended complaint. Kyocera Communications Inc. Jul. 21, 2009.
Kyocera Wireless Corp's answer, affirmative defenses and counterclaims to plantiff's amended complaint. Kyocera Wireless Corp. Jul. 21, 2009.
Palm Inc.'s answer, affirmative defenses and counterclaims to plaintiff's amended complaint. Palm Inc. Jul. 21, 2009.
Defendant HTC Corporation's answer and counterclaim to plaintiff's amended complaint. HTC Corporation. Sep. 25, 2009.
Defendant HTC America Inc's answer and counterclaim to plaintiff's amended complaint. HTC America Inc. Sep. 25, 2009.
Defendants Samsung Electronics Co., Ltd.'s; Samsung Electronics Research Institute's and Samsung Semiconductor Europe GMBH's answer; and Samsung Telecommunications America LLC's answer and counterclaim to the amended complaint of plaintiff Fractus, SA. Oct. 1, 2009.
Defendants Research in Motion LTD, and Research in Motion Corporation's answers, defenses and counterclaims to plaintiff's amended complaint. Oct. 1, 2009.
Defendants LG Electronics Inc., LG Electronics USA, Inc., and LG Electronics Mobilecomm USA Inc. answer and counterclaim to amended complaint. Oct. 1, 2009.
Defendants HTC America, Inc's first amended answer and counterclaims to plaintiff's amended complaint. Oct. 2, 2009.
Defendants Research in Motion LTD, and Research in Motion Corporation's amended answer, defenses and counterclalims to plaintiff's amended complaint. Nov. 24, 2009.
Answer, affirmative defenses and counterclaims to the second amended complaint for patent infringement on behalf of Defendant Pesonal Communications Devices Holdings, LLC. Dec. 17, 2009.
Defendant HTC America, Inc's answer and counterclaims to plaintiff's second amended complaint. Dec. 21, 2009.
Defendant HTC Corporation's answer and counterclaims to plaintiff's second amended complaint. Dec. 21, 2009.

Defendant Research in Motion LTD and Research in Motion Corporation's second answer, defenses and counerclaims to plaintiff's second amended complaint. Dec. 21, 2009.
Defendant Pantech Wireless, Inc.'s answer, affirmative defenses and counterclaims to Fractus SA's second amended complaint. Dec. 21, 2009.
Defendant Sanyo Electric Co. LTD's answer to second amended complaint for patent infringement. Dec. 22, 2009.
Defendant Sanyo North America Corporation's answer to second amended complaint for patent infringement. Dec. 22, 2009.
Defendant UTStarcom, Inc's answer, affirmative defenses and counterclaims to Fractus SA's second amended complaint. Dec. 22, 2009.
Palm, Inc's answer, affirmative defenses and counterclaims to paintiff's second amended complaint. Dec. 22, 2009.
Kyocera Communications Inc's answer, affirmative defenses and counterclaims to paintiff's second amended complaint Dec. 22, 2009.
Kyocera Wireless Corp's answer, affirmative defenses and counterclaims to paintiff's second amended complaint Dec. 22, 2009.
Defendants Samsung Electronics Co., Ltd.'s; Samsung Electronics Research Institute's and Samsung Semiconductor Europe GMBH's answer; and Samsung Telecommunications America LLC's answer and counterclaim to the second amended complaint of plaintiff Fractus, SA. Dec. 23, 2009.
Defendants LG Electronics Inc., LG Electronics USA, Inc., and LG Electronics Mobilecomm USA Inc. answer and counterclaim to second amended complaint. Dec. 28, 2009.
Answer of the Sharp Defendants to plaintiff's second amended complaint. Dec. 29, 2009.
Amended answer of the Sharp defendants to plaintiff's second amended complaint. Feb. 24, 2010.
Defendants Samsung Electronics Co., Ltd.'s; Samsung Electronics Research Institute's and Samsung Semiconductor Europe GMBH's first amended answer; and Samsung Telecommunications America LLC's first amended answer and counterclaim to the second amended complaint of plaintiff Fractus, SA. Feb. 24, 2010.
Defendants LG Electronics Inc., LG Electronics USA, Inc., and LG Electronics Mobilecomm USA Inc. First amended answer and counterclaim to second amended complaint. Jan. 24, 2010.
Defendant HTC America, Inc.'s amended answer and counterclaim to plaintiff's second amended complaint. Feb. 24, 2010.
Defendant HTC Corporation's amended answer and counterclaim to plaintiff's second amended complaint. Feb. 24, 2010.
Defendant HTC Corporation's amended answer and counterclaim to plaintiff's second amended complaint. Feb. 25, 2010.
Defendant HTC America, Inc.'s amended answer and counterclaim to plaintiff's second amended complaint. Feb. 25, 2010.
Fractus's answer to defendant Pantech Wireless Inc. in the case of *Fractus SA* vs. *Samsung Electronics* cp. 24, Jun. 2009.
Fractus's answer to defendant UT Starcom, Inc. counterclaims. in the case of *Fractus SA* vs. *Samsung Electronics* cp. 29, Jun. 2009.
Complaint for patent infringement—Case 6:09-cv-00203. Fractus. May 5, 2009.
Civil cover sheet—Case 6:09-cv-00203. Fractus. May 5, 2009.
Amended complaint for patent infringement—Case 6:09-cv-00203. May 6, 2009.
Second amended complaint for patent infringement—Case 6:09-cv-00203. Dec. 2, 2009.
Second amended complaint for patent infringement—Case 6:09-cv-00203. Dec. 8, 2009.
Plaintiff Fractus, S. A.'s answer to defendant personal communications devices holdings, LLC's counterclaims to the Second Amended Complaint—Case 6:09-cv-00203. Jan. 4, 2010.
Plaintiff Fractus, S. A.'s answer to the counterclaims of defendants Research in Motion LTD. and Research in Motion Corporation to the Second Amended Complaint—Case 6:09-cv-00203. Jan. 4, 2010.
Plaintiff Fractus, S. A.'s answer to counterclaims of defendant Pantech Wireless, Inc. to the Second Amended Complaint—Case 6:09-cv-00203. Jan. 4, 2010.
Plaintiff Fractus, S. A.'s answer to counterclaims of defendant Kyocera Communications, Inc's Counterclaims to the Second Amended Complaint—Case 6:09-cv-00203. Jan. 4, 2010.
Plaintiff Fractus, S. A.'s answer to defendant Kyocera Wireless Corp's Counterclaims to the Second Amended Complaint—Case 6:09-cv-00203. Jan. 4, 2010.
Plaintiff Fractus, S. A.'s answer to defendant Palm, Inc's Counterclaims to the Second Amended Complaint—Case 6:09-cv-00203. Jan. 4, 2010.
Plaintiff Fractus, S. A.'s answer to defendant UTStarcom, Inc's Counterclaims to the Second Amended Complaint—Case 6:09-cv-00203. Jan. 4, 2010.
Plaintiff Fractus, S. A.'s answer to counterclaims of defendant Samsung Telecommunications America LLC to the Second Amended Complaint—Case 6:09-cv-00203. Jan. 4, 2010.
Plaintiff Fractus, S. A.'s answer to counterclaims of defendants LG Electronics Inc., Electronics USA, Inc., and LG Electronics Mobilecomm USA, Inc. to the Second Amended Complaint—Case 6:09-cv-00203. Jan. 4, 2010.
Plaintiff Fractus, S. A.'s answer to counterclaims of defendants HTC America, Inc to the Second Amended Complaint—Case 6:09-cv-00203. Jan. 14, 2010.
Plaintiff Fractus, S. A.'s answer to amended counterclaims of defendant Samsung Telecommunications america LLC's to Fractus's Second Amended Complaint—Case 6:09-cv-00203. Apr. 1, 2010.
Plaintiff Fractus, S. A.'s answer to amended counterclaims of defendant HTC Corporation to Fractus's Second Amended Complaint—Case 6:09-cv-00203. Apr. 1, 2010.
Plaintiff Fractus, S. A.'s answer to amended counterclaims of defendant HTC America, Inc. To Fractus's Second Amended Complaint—Case 6:09-cv-00203. Apr. 1, 2010.
Plaintiff Fractus, S. A.'s answer to amended counterclaims of defendant LG Electronics Inc., Lg Electronics USA, Inc., and LG Electronics Mobilecomm USA Inc's to Fractus's Second Amended Complaint—Case 6:09-cv-00203. Apr. 1, 2010.
Love , J. D. Memorandum opinion and order. Court 20110120.
NA. Defendant's notice of compliance regarding second amended invalidity contentions. Defendants 20110121.
NA. Fractus' reply to defendant's motion for reconsideration of, and objections to, magistrate Judge Love's markman order. Fractus 20110204.
NA. Declaration of Thomas E. Nelson—Exhibit A—Antenna photos. Defendants 20110203.
NA. Report and recommendation of United States magistrate judge. Court 20110208.
NA. Order adopting report and recommendation of magistrate judge. Court 20110211.
NA. Notice of compliance with motion practice orders. Fractus 20110214.
NA. Defendants LG Electronics Inc, LG Electronics USA, and LG Electronics Mobilecomm USA Inc's second amended answer and counterclaim to second amended complaint. Defendants 20110228.
NA. Reply brief in support of Defendant's motion for reconsideration of the court's ruling on the term "at least a portion" in the court's Dec. 17, 2010 claim construction order based on newly-available evidence. Defendants 20110225.
NA. Defendants Samsung Electronics Co LTD (et al) second amended answer and counterclaims to the second amended complaint of plaintiff Fractus SA. Defendants 20110228.
NA. Defendant Pantech Wireless Inc amended answer, affirmative defenses, and counterclaims to Fractus' second amended complaint. Defendants 20110228.
Litigation—Invalidity Contentions—Defendants Defendants Invalidity contentions including apendix and exhibits refering Multiband Monopole. Defendants 20100208.
Infringement Chart—Kyocera MARBL. Patent: 7411556 Fractus 20091105.
Infringement Chart—Kyocera S2400. Patent: 7411556 Fractus 20091105.
Infringement Chart—Kyocera NEO E1100. Patent: 7411556 Fractus 20091105.
Infringement Chart—LG Shine CU720. Patent: 7411556 Fractus 20091105.
Infringement Chart—LG Rumor. Patent: 7411556 Fractus 20091105.

Infringement Chart—LG Voyager VX10000. Patent: 7411556 Fractus 20091105.
Infringement Chart—LG VX8350. Patent: 7411556 Fractus 20091105.
Infringement Chart—LG Vu CU920. Patent: 7411556 Fractus 20091105.
Infringement Chart—LG VX5400. Patent: 7411556 Fractus 20091105.
Infringement Chart—LG VX5500. Patent: 7411556 Fractus 20091105.
Infringement Chart—LG AX8600. Patent: 7411556 Fractus 20091105.
Infringement Chart—LG Flare LX165. Patent: 7411556 Fractus 20091105.
Infringement Chart—LG Aloha LX140. Patent: 7411556 Fractus 20091105.
Infringement Chart—LG Chocolate VX8550. Patent: 7411556 Fractus 20091105.
Infringement Chart—LG Muziq LX570. Patent: 7411556 Fractus 20091105.
Infringement Chart—LG VX9400. Patent: 7411556 Fractus 20091105.
Infringement Chart—LG VX8560 Chocolate 3. Patent: 7411556 Fractus 20091105.
Infringement Chart—LG EnV3 VX9200. Patent: 7411556 Fractus 20091105.
Infringement Chart—LG Lotus. Patent: 7411556 Fractus 20091105.
Infringement Chart—LG AX155. Patent: 7411556 Fractus 20091105.
Infringement Chart—LG enV Touch VX1100. Patent: 7411556 Fractus 20091105.
Infringement Chart—LG AX380. Patent: 7411556 Fractus 20091105.
Infringement Chart—LG VX8360. Patent: 7411556 Fractus 20091105.
Infringement Chart—Pantech Breeze C520. Patent: 7411556 Fractus 20091105.
Infringement Chart—Patench DUO C810. Patent: 7411556 Fractus 20091105.
Infringement Chart—Blackberry 8110. Patent: 7411556 Fractus 20091105.
Infringement Chart—Blackberry 8120. Patent: 7411556 Fractus 20091105.
Infringement Chart—Blackberry 8310. Patent: 7411556 Fractus 20091105.
Infringement Chart—Blackberry 8330. Patent: 7411556 Fractus 20091105.
Infringement Chart—Blackberry 8130. Patent: 7411556 Fractus 20091105.
Infringement Chart—Blackberry 8320. Patent: 7411556 Fractus 20091105.
Infringement Chart—Blackberry 8220. Patent: 7411556 Fractus 20091105.
Infringement Chart—Blackberry 8100. Patent: 7411556 Fractus 20091105.
Infringement Chart—Blackberry 8820. Patent: 7411556 Fractus 20091105.
Infringement Chart—Blackberry 8830. Patent: 7411556 Fractus 20091105.
Infringement Chart—Samsung SCH-R500. Patent: 7411556 Fractus 20091105.
Infringement Chart—Samsung M320. Patent: 7411556 Fractus 20091105.
Infringement Chart—Samsung SCH U340. Patent: 7411556 Fractus 20091105.
Infringement Chart—Samsung SCH U410. Patent: 7411556 Fractus 20091105.
Infringement Chart—Samsung SCH-R430. Patent: 7411556 Fractus 20091105.
Infringement Chart—Samsung SCH U700. Patent: 7411556 Fractus 20091105.
Infringement Chart—Samsung SCH-U940. Patent: 7411556 Fractus 20091105.
Infringement Chart—Samsung SGH A117. Patent: 7411556 Fractus 20091105.
Infringement Chart—Samsung SCH A127. Patent: 7411556 Fractus 20091105.
Infringement Chart—Samsung SGH T229. Patent: 7411556 Fractus 20091105.
Infringement Chart—Samsung SGH T439. Patent: 7411556 Fractus 20091105.
Infringement Chart—Samsung SGH T919. Patent: 7411556 Fractus 20091105.
Infringement Chart—Samsung SGH-A437. Patent: 7411556 Fractus 20091105.
Infringement Chart—Samsung SGH A867. Patent: 7411556 Fractus 20091105.
Infringement Chart—Samsung SCH-U310. Patent: 7411556 Fractus 20091105.
Infringement Chart—Samsung SGH-A237. Patent: 7411556 Fractus 20091105.
Infringement Chart—Samsung SGH-T639. Patent: 7411556 Fractus 20091105.
Infringement Chart—Samsung SGH-A837. Patent: 7411556 Fractus 20091105.
Infringement Chart—Samsung SCH-R600. Patent: 7411556 Fractus 20091105.
Infringement Chart—Samsung SCH-U520. Patent: 7411556 Fractus 20091105.
Infringement Chart—Samsung SCH-U750. Patent: 7411556 Fractus 20091105.
Infringement Chart—Samsung SGH-T219. Patent: 7411556 Fractus 20091105.
Infringement Chart—Samsung SGH-T929. Patent: 7411556 Fractus 20091105.
Infringement Chart—Samsung SCH-A645. Patent: 7411556 Fractus 20091105.
Infringement Chart—Samsung FlipShot SCH-U900. Patent: 7411556 Fractus 20091105.
Infringement Chart—Samsung SGH-A257. Patent: 7411556 Fractus 20091105.
Infringement Chart—Samsung SGH-T559. Patent: 7411556 Fractus 20091105.
Infringement Chart—Samsung SPH-M550. Patent: 7411556 Fractus 20091105.
Infringement Chart—Sanyo Katanna II. Patent: 7411556 Fractus 20091105.
Infringement Chart—Sanyo Katana LX. Patent: 7411556 Fractus 20091105.
Infringement Chart—Sharp Sidekick LX. Patent: 7411556 Fractus 20091105.
Infringement Chart—UTStarcom CDM7126. Patent: 7411556 Fractus 20091105.
Defendant's reply in suport of their motion for summary judgment of invalidity based on indefiniteness and lack of written description for certain terms Defendants 20100830.
NA. Expert declaration by Dr. D. Jaggard including exhibits (curriculum and datasheets from Cushcraft, Antenova, Ethertronics and Taoglas) Fractus 20100816.
NA. Fractus's opposition to defendants' motion for summary judgement of invalidity based on indefiniteness and lack of written description for certain terms Fractus 20100816.
Howe, M. Declaration of Micah Howe in support of Fractus SA opposition to defendants' motion for summary judgement of invalidity based on indefiniteness and lack of written description for certain terms Heim, Payne and Chorus LLP 20100816.
NA. IEEE Standard Dictionary of Electrical and Electronics. Terms IEEE Press (6th ed.) pp. 359, 688, and 878 19960101.
Werner, D. H and Mittra, R. Frontiers in electromagnetics. IEEE Press. pp. 5-7 20000101.
Nelson, Thomas R.; Jaggard, Dwight L. Fractals in the Imaging Sciences J. Optical Society AM. 19990101.
Stutzman, W. ; Thiele, G. Antenna theory and design. John Wiley and Sons. Pags. 18, 36 19810101.
Jaggard, D. Diffraction by Bandlimited Fractal Screens. Optical Society AM 19870601.

Feder, J. Fractals. Plenum Press. pp. 10-11, 15-17, and 25 19880101.
Fleishmann, M.; Tildesley, DJ; Balls, RC. Fractals in the natural sciences. Royal Society of London 19990101.
Kritikos, H.N.; Jaggard, D.L. Recent advances in electromagnetic theory—Chapter 6 on fractal electrodynamics. Springer—Verlag. Chapter 6 19901001.
Caswell, W. E. Invisible errors in dimensions calculations: geometric and systematic effects Dimensions and Entropies in Chaotic Systems 19860101.
NA. European Patent Convention—Article 123 European Patent Office 20000101.
Kyriacos, S.; Buczkowski, S. et al. A modified box-counting method Fractals—World Scientific Publishing Company 19940101.
Carpintero, F. Reply to the Written Opinion for the PCT patent application ES99/00296 dated Nov. 15, 2001 Herrero & Asociados 20011115.
Werner, D. H. et al. Frontiers in Electromagnetics—Chapter 3—The Theory and design of fractal antenna arrays IEEE Press Series 20000101.
Balanis, Constantine A. Antenna theory—Analysis and design—Chapter 2—Fundamental parameters of antennas John Wiley & Sons 19820101.
Sauer, J. M. Preliminary amendment for the U.S. Appl. No. 10/963,080 Jones Day. Case 6:09-cv-00203-LED-JDL 20041210.
NA. Merriam-Webster's Collegiate Dictionary (1993) Merriam-Webster's. Case 6:09-cv-00203-LED-JDL 19930101.
Chen, Z. N. Broadband probe-fed L-shaped plate antenna Microwave and Optical Technology Letters 20000805.
NA. American Heritage College Dictionary (1997). Pags 340 and 1016 Mifflin Comp. Case 6:09-cv-00203-LED-JDL 19970101.
Buczkowski, Stéphane; Kyriacos. The modified box-countig method: analysis of some characteristic paramenters. Pattern Recognition 19980420.
Wolin, H. A. Preliminary Amendment of U.S. Appl. No. 10/102,568 Rosenman & Colin LLP 20020312.
Menefee, J. Office Action for the US patent reexamination 95/001,390, dated Aug. 12, 2010 USPTO 20100812.
Menefee, James. Office Action for the US patent reexamination 95/001,389, dated Aug. 12, 2010 USPTO 20100812.
Phan, T. Office Action for U.S. Appl. No. 10/102,568, dated Jan. 23, 2004 USPTO 20040123.
*Fractus* vs. *Samsung et al.* Claim construction and motion for summary judgement—Markman Hearing—[Defendants] Defendants 20100902.
Fractus' Claim Construction Presentation—Markman Hearing—*Fractus* v. *Samsung* et al. 609-cv-00203 Sep. 2, 2010 20100902.
Love, J. Memorandum order and opinion. Court 20101217.
Gianvittorio, John Paul et al. Fractal antennas—a novel antenna miniturization technique and applications Antennas and Propagation Magazine, IEEE 20020201.
Best, Steven R. The fractal loop antenna: a comparison of fractal and non-fractal geometries Antennas and Propagation Society International Symposium, 2001. IEEE 20010101.
Romeu, J. et al. Fractal FSS—A novel dual-band frequency selective surface Antennas and Propagation, IEEE Transactions on 20000701.
Fanjul, J. International Preliminary Examination Report for application No. PCT/ES99/00296 EPO 20011219.
NA. Fractus's Objections to claim construction memorandum and order. Case 6:09-cv-00203. Fractus 20110114.
Puente, C.; Romeu, J.; Cardama, A. Fractal-shaped antennas Frontiers in electromagnetics—IEEE Press 20000101.
Love, J. Court Order. Provisional claim construction and motion for summary judgement. Provisional markman order. Court 20101109.
Jaggard, D. L. Rebuttal expert report of Dr. Dwight L. Jaggard (redacted version) Fractus 20110216.
Long, S. A. Rebuttal expert report of Dr. Stuart A. Long (redacted version) Fractus 20110216.
Stutzman, W. L. Rebuttal expert report of Dr. Warren L. Stutzman (redacted version) Fractus 20110216.
Borowski, E. J. Dictionary of Mathematics Collins—Case 6:09-cv-00203-LED-JDL 19890101.
Mehaute, A. Fractal Geometrics CRC Press—Case 6:09-cv-00203-LED-JDL 19900101.
NA. Defendants RIM, Samsung, HTC, LG and Pantech's response to plantiff Fractus SA's opening claim construction brief in Case 6:09-cv-00203-LED-JDL Defendants 20100730.
NA. Defendants RIM, Samsung, HTC, LG and Pantech's response to plantiff Fractus SA's opening claim construction brief in Case 6:09-cv-00203-LED-JDL—Exhibit 41—Demonstrative re: counting segments Defendants 20100730.
NA. Defendants RIM, Samsung, HTC, LG and Pantech's response to plantiff Fractus SA's opening claim construction brief in Case 6:09-cv-00203-LED-JDL—Exhibit 42—Demonstrative showing how straight segments can be fitted over a curved surface Defendants 20100730.
NA. Defendants RIM, Samsung, HTC, LG and Pantech's response to plantiff Fractus SA's opening claim construction brief in Case "6:09-cv-00203-LED-JDL"—Exhibit 1—Chart of Agreed Terms and Disputed Terms Defendants 20100730.
NA. Defendants RIM, Samsung, HTC, LG and Pantech's response to plantiff Fractus SA's opening claim construction brief in "Case 6:09-cv-00203-LED-JDL"—Exhibit 2—Family Tree of Asserted Patents Defendants 20100730.
NA. Response of defendants Kyocera Communications, Inc; Palm Inc. and UTStarcom, Inc. to plantiff Fractus SA's opening claim construction brief in "Case 6:09-cv-00203-LED-JDL" Defendants 20100730.
NA. Claims for the EP patent 00909089. Herrero y Asociados 20050128.
NA. The American Heritage College Dictionary—pag 684, 1060 Houghton Mifflin Comp.—3d ed.—Case 6:09-cv-00203-LED-JDL 19970101.
NA. The American Heritage Dictionary of the English Language Houghton Mifflin Company—4th ed.—Case 6:09-cv-00203-LED-JDL 20000101.
Walker, B. D. Response office action for the U.S. Appl. No. 11/179,250 Howison & Arnott—Case 6:09-cv-00203-LED-JDL 20050712.
Walker, B. Preliminary amendment for the U.S. Appl. No. 11/780,932, dated Jul. 20, 2007 Howison & Arnott—Case 6:09-cv-00203-LED-JDL 20070720.
Theiler, J. Estimating fractal dimension J. Opt. Soc. Am. A. Case 6:09-cv-00203-LED-JDL 19900601.
Moore, S. Response to Office Action dated Feb. 7, 2006 of U.S. Appl. No. 11/033,788 Jenkens & Gilchrist 20060601.
Stutzman, W. L.; Thiele, G. A. Antenna theory and design John Wiley and Sons. pp. 8-9, 43-48, 210-219 19980101.
Rich, Barnett. Review of Elementary Mathematics 2d ed.1997 McGraw—Hill—Case 6:09-cv-00203-LED-JDL 19970101.
Sclater, N.; Markus, J. McGraw-Hill Electronics Dictionary McGraw—Hill 19970101.
Johnson, R. Antenna engineering handbook (3rd. edition)—pp. 14-1—14-5 McGraw-Hill 19930101.
Dictionary of Scientific & Technical Terms (6th Ed., 2002) pag 1489 McGraw-Hill 20020101.
Parker, S. McGraw-Hill Dictionary of Scientific and Technical Terms (5th ed. 1994) McGraw-Hill—Case 6:09-cv-00203-LED-JDL 19940101.
NA. The American Heritage Dictionary—pag 817, 961 Morris—William—(Second College edition)—Case 6:09-cv-00203-LED-JDL 19820101.
Henderson West, B. The Prentice-Hall encyclopedia of mathematics Prentice-Hall 19820101.
West, B.H. et al. The Prentice-Hall Encyclopedia of Mathematics (1982) Prentice-Hall—Case 6:09-cv-00203-LED-JDL 19820101.
NA. IEEE Standard Definitions of Terms for Antennas, IEEE Std. 145-1993 (1993) the Institute of Electrical and Electronics Engineers—Case 6:09-cv-00203-LED-JDL 19930318.
Borja, C. Antenas fractales microstrip Universitat Politécnica de Catalunya 19970701.
Phan, T. Notice of allowance of U.S. Appl. No. 10/963,080, dated Sep. 1, 2005. USPTO 20050901.
Phan, T. Notice of allowance of U.S. Appl. No. 11/102,390, dated Jul. 6, 2006. USPTO 20060706.
Phan, T. Notice of allowance of U.S. Appl. No. 11/179,257, dated Oct. 19, 2006 USPTO 20061019.

Phan, T. Office Action for U.S. Appl. No. 11/550,256, dated Jan. 15, 2008 USPTO 20080115.
Wimer, M. Notice of allowance of U.S. Appl. No. 10/822,933, dated Oct. 18, 2007 USPTO 20071018.
Collier, C. P. Geometry for teachers Waveland Press, Inc. 19840101.
Mandelbrot, B. B. Opinions (Benoit B. Mandelbrot) World Scientific Publishing Company—Case 6:09-cv-00203-LED-JDL 19930101.
Werner, D. H.; Werner, P. L.; Ferrare, A. J. Frequency independent features of self-similar fractal antennas Antennas and Propagation Society International Symposium, 1996. AP-S. Digest 19960721.
Foroutan-pour, K.; Dutilleul, P.; Smith, D.L. Advances in the implementation of the box-counting method of fractal dimension estimation Applied Mathematics and Computation; Elsevier 19990501.
Graf, R. Modern dictionary of electronics Butterworth-Heinemann (6th Ed.) 19840101.
NA. Collins Dictionary—Pag608. Collins 19790101.
NA. Int'l Electro-Technical Commission IEV No. 712-01-04—Electropedia: the world's online electrotechnical vocabulary Electropedia—Commission Electrotechnique Internationale—http://www.electropedia.org 19980401.
NA. Webster's New Collegiate Dictionary G & C Merriam Co. 19810101.
NA. IEEE Standard dictionary of electrical and electronics terms IEEE Standard (6th ed.) 19960101.
Sawaya, K.; Ishizone, T.; Mushiake, Y. A simplified Expression of Dyadic Green's Function for a Conduction Half Sheet vol. AP-29, No. 5 (Sep. 1981) IEEE Transactions on Antennas & Propagation 19810901.
Pozar, D.; Newman, E. Analysis of a Monopole Mounted near or at the Edge of a Half-Plane IEEE Transactions on Antennas and Propagation 19810501.
Johnson, R. Antenna engineering handbook—pp. 4-26—4-33 Mc Graw Hill—(3rd Ed.) 19930101.
NA. The American Heritage Dictionary—pag 311, 1208 New College ed. (2nd ed.) 19820101.
NA. The American Century Dictionary Oxford University Press 19950101.
Rademacher, H.; Toeplitz, O. The Enjoyment of Math Princeton Science Library 19570101.
NA. The Random House Dictionary Random House 19840101.
Pressley, A. Elementary Differential Geometry Springer 20000101.
Peitgen & D. Saupe, H. The science of fractal images Springer-Verlag 19880101.
Peitgen et al, H O. Chaos and fractals: new frontiers of science. Pags. 22-26, 62-66, 94-105, 212-219, 229-243 Springer-Verlag 19920101.
Nguyen , H. Notice of Allowance of U.S. Appl. No. 10/182,635, dated Apr. 4, 2005 USPTO 20050411.
Request for Inter partes reexamination of U.S. Appl. No. 7/411,556—95/000,600, dated Dec. 3, 2010—Exhibits.
Request for Inter partes reexamination of U.S. Appl. No. 7/411,556—95/000,590, dated Dec. 16, 2010—Exhibits.
Request for inter partes reexamination of U.S. Appl. No. 7/411,556—95/001,462, dated Oct. 1, 2010—Exhibits.
Vinoy, K. J. et al. Hilbert curve fractal antenna: a small resonant antenna for VHF/UHF applications. Microwave and Optical Technology Letters. Pag 215-219 20010501.
Na. Amendments and Review of CN patent application No. 01823716.9 of OA dated Feb. 16, 2007. Patent and Trademark Office, China Council for the Promotion of International Trade Patent and Trademark Office, China Council for the Promotion of International Trade 20070821.
Feng, Liu. Office Action of CN patent application 018237169 dated Feb. 16, 2007 The State Intelletual Property Office of the People's Republic of China 20070216.
NA. Response to Second OA of CN patent application No. 01823716.9 dated Sep. 21, 2007 CCPIT Patent and Trademark Law Office 20071203.
Feng, Liu. Second Office Action of CN patent application 018237169 dated Sep. 21, 2007 The State Intellectual Property Office of the People's Republic of China 20070921.
NA. FCC—United States table of frequency allocations. 377-538 Federal Communications Commission 19991001.
NA. United States Table of Frequency allocations—The Radio Spectrum United States Department of Commerce 19960301.
Buczkowski, Stephane; Kyriacos, Soula; Nekka, Fahima; Cartilier, Louis. The modified box-countig method: analysis of some characteristic paramenters. 411-418(8) Pattern Recognition 19980420.
Kyriacos, S.; Buczkowski, S. et al. A modified box-counting method. 321-324 Fractals—World Scientific Publishing Company 19940101.
Mehaute, A. Fractal Geometrics. 3-35 CRC Press—Case 6:09-cv-00203-LED-JDL 19900101.
Barnsley, M. Fractals Eveywhere Academic Press Professional 19930101.
Shafer, G. Probability and Finance John Wiley & Sons 20010101.
Parron, J.; Rius, J.; Romeu, J. Study of the Koch fractal monopole in the frequency domain Fractalcoms 20020530.
Fractus SA's opening claim construction brief,—Exhibit 1—Parties' Proposed Constructions—Case 6:09-cv-00203- LED-JDL Fractus 20100716.
Fractus SA's opening claim construction brief—Exhibit 2—Parties' Agreed Constructions Fractus 20100716.
Fractus SA's opening claim construction brief Fractus—Case 6:09-cv-00203-LED-JDL 20100716.
NA Fractus SA's Opening Claim Construction Brief with Parties' Proposed and Agreed Constructions in the case of *Fractus SA* v. *Samsung Electornics Co. Ltd. et al.* Fractus—Case 6:09-cv-00203-LED-JDL. 20100716.
Jaggard, D. L. Expert report of Dwight L. Jaggard (redacted)—expert witness retained by Fractus. Fractus 20110223.
Long, S. Expert report of Stuart Long (redacted)—expert witness retained by Fractus. Fractus 20110223.
Stutzman, W. L. Expert report of Dr. Warren L. Stutzman (redacted)—expert witness retained by Fractus. Fractus 20110223.
Sterne, R. G. Response to the Office Action for the U.S. Appl. No. 95/001,390, dated Aug. 19, 2010 Sterne, Kessler, Goldstein & Fox PLLC. 20101119.
NA. Letter from Baker Botts to Howison & Arnott LLP including exhibits Baker. Botts 20100805.
NA. Letter from Baker Botts to Kenyon & Kenyon LLP, Winstead PC and Howison & Arnott LLP including exhibits. Baker Botts 20091028.
Naik, A.; Bathnagar, P. S. Experimental study on stacked ring coupled triangular microstrip antenna Antenna Applications Symposium, 1994. 19940921.
NA. Letter to FCC—Application form 731 and Engineering Test Report by Nokia Mobile Phones for FCC ID: LJPNSW-6NX M. Flom Associates 19990401.
NA. OET Exhibits list for FCC ID: LJPNSW-6NX Federal Communications Commission—FCC 19990708.
Wikka, K. Letter to FCC that will authorize the appointment of MORTON FLOM Eng and/or FLOMASSOCIATES INC to act as their Agent in all FCC matters. Nokia Mobile Phones 19990805.
Posio, E. Letter to FCC—Request for confidentiality on the information accompanying the application of FCC ID: GMLNSW-4DX. Nokia Mobile Phones 20000207.
NA. OET Exhibits List for FCC ID: GMLNSW-4DX. Office of Engineering and Technology—FCC 20000908.
Nokia Mobile Phones. Exhibit 9: Internal Photographs FCC ID: LJPNPW-1NB Federal Communication Commission—FCC. 20010215.
NA. OET Exhibits list for FCC ID: LJPN-1NB Federal Communications Commission—FCC 20010503.
Watson, T.; Friesser, J. A phase shift direction finding technique Annual Symposium on the USAF antenna research and development program 19571021.
McCormick , J. A Low-profile electrically small VHF antenna 15th Annual Symposium on the USAF antenna reserach and development program 19651012.
Lyon, J.; Rassweiler, G.; Chen, C. Ferrite-loading effects on helical and spiral antennas 15th Annual Symposium on the USAF antenna reserach and development program 19651012.
Paschen, D. A.; Olson, S. A crossed-slot antenna with an infinite balun feed Antenna Applications Symposium, 1995. 19950920.
Posio, E. Letter to FCC—Electronic Serial No. for FCC ID: GMLNSW-4DX Nokia Mobile Phones 20000207.

Posio, E. Letter to FCC about GMLNSW-4DX complies with ANSI/IEEE C95.1-1992 Standard for Safety Levels Nokia Mobile Phones 20000307.
Graff, W. Letter to FCC—Test Report GMLNSW-4DX M. Flom Associates—MFA 20000317.
Graff, B. Form 731 Corrections: GMLNSW-4DX M. Flom Associates—MFA 20000424.
Flom, M. Letter to FCC—Nokia SAR Information M. Flom Associates—MFA 20000519.
Flom, M. Letter to FCC—Communication of replacing employee M. Flom Associates 20000523.
Myrskog , M Letter to FCC—Letter that will authorize the appointment of MORTON FLOM Eng and/or FLOMASSOCIATES INC to act as their Agent in all FCC matters Nokia Mobile Phones 20000914.
NA SAR-Evaluation—DASY3 Dipole ValidationKit—Type: D1900V2—Serial: 511 Schimd and Partner Engineering AG 20010213.
NA SAR-Evaluation—DASY3 Dipole ValidationKit—Type: D835V2—Serial: 405 Schmid and Partner Engineering AG 20010213.
Salow, S. Letter to FCC—About LJPNPW-1 NB complies with ANSI/IEEE C95.1-1992 Standard for Safety Levels Nokia Mobile Phones 20010226.
Salow, S. Letter to FCC—FCC ID LJPNPW-1NB complies with OET Bulletin No. 53 as referenced in Section 22.915 of the Commissions rules and with EIA/TIA/IS-54-B Nokia Mobile Phones 20010226.
Salow, S. Request for confidentiality of the information accompanyinh the application of FCC ID: LJPNPW-1NB M. Flom Associates—MFA 20010226.
Flom, M. Letter to FCC—Application form 731 and Engineering Test Report by Nokia Mobile Phones for FCC ID: LJPNPW-1NB M. Flom Associates—MFA 20010312.
Flom, M. Letter to modify the Emission Designator M. Flom Associates—MFA 20010330.
Zhang, S. Huff, G.; Bernhard, T. Antenna efficiency and gain of two new compact microstrip antennas Antenna Applications symposium, 2001 20010919.
Posio, E. Letter to FCC—About GMLNPW-3 complies with ANSI/IEEE C95.1-1992 Standard for Safety Levels Nokia Mobile Phones 20011207.
Posio, E. Letter to FCC—Compliance Statement of GMLNPW-3 Nokia Mobile Phones 20011207.
Poiso, E. Letter to FCC—Electronic Serial No. for FCC ID: GMLNPW-3 Nokia Mobile Phones 20011207.
Posio, E. Letter to FCC—Request for confidentiality of the information accompanying the application of FCC ID: GMLNPW-3 Nokia Mobile Phones 20011207.
Ewing, A Letter and Engineering Test Report of FCC ID: GMLNPW-3 Test and Certification Center—TCC 20011219.
NA Nokia. Antenna Photos—FCC ID: GMLNPW-3 Federal Communications Commission—FCC 20020219.
Nokia Nokia MBD-11 Mobile Holder—SAR Specification Nokia 20020301.
IEEE Standards Uncertainty System Check (Dipole Validation)—IEEE P1528 Schmid and Partner Engineering AG 20030101.
Meier, K.; Burkhard, M.; Schmid, T. et al Broadband calibration of E-field probes in Lossy Media IEEE Transactions on Microwave Theory and Techniques 19961001.
NA Fractus's sur-reply to defendants' motion for reconsideration of the court's Dec. 17, 2010 claim construction order based on newly-available evidence—Document 666 Fractus 20110308.
NA Order—Document 670 Court 20110309.
NA Plaintiff Fractus SA's answer to second amended counterclaims of defendant HTC Corporation to Fractus's second amended complaint—Document 678 Fractus 20110314.
NA Plaintiff Fractus SA's answer to second amended counterclaims of defendant HTC to Fractus's second amended complaint—Document 680 Fractus 20110314.
NA Plaintiff Fractus SA's answer to second amended counterclaims of defendant LG Electronics to Fractus's second amended complaint—Document 694 Fractus 20110315.
NA Plaintiff Fractus SA's answer to second amended counterclaims of defendant Samsung to Fractus's second amended complaint—Document 695 Fractus 20110315.
NA Plaintiff Fractus SA's answer to amended counterclaims of defendant Pantech Wireless Inc to Fractus's second amended complaint—Document 696 Fractus 20110315.
Davis, Leonard Order—Document 783. United States District Judge 20110401.
Tribble, M. L. Letter to John D. Love—Document 715—Permission to file a summary judgment motion of no indefiniteness on the issues wher the Court's Report and Recommendation already has held that the claim term is not indefinite Susman Godfrey 20110318.
Tribble, M. L. Letter to John D. Love—Document 716—Permission to file a partial summary judgement motion on infringement. Susman Godfrey, LLP 20110318.
Sirola, Neil P. Letter to John D. Love—Document 721—Permission to file a motion for summary judgment of invalidity of the following 7 asserted claims from the MLV, patent family . . . Baker Botts, LLP 20110318.
Howe, Micah J. Fractus, S.A.'s objections to the Court's Mar. 9, 2011, Order—Document 768 Susman Godfrey LLP 20110325.
Jones, Michael E. Defendants' opposition to Fractus SA objections to the Court's Mar. 9, 2011 Order—Document 780 Baker Botts, LLP 20110331.
NA Stipulation of Dismissal of all Claims and Counterclaims re '850 and '822—Document 841 Defendants 20110415.
NA Joint Motion to Dismiss Claims and Counterclaims re '850 and '822—Document 843 Defendants 20110415.
Na Defendants' Motion to Clarify Claim Construction—Document 854 Defendants 20110418.
Love, J. D. Order—Document 868 United States Magristrate Judge 20110419.
Behncke, M. Fractus's surreply to defendants' Motion for Summary Judgment re publication dates of three references—Document 876 Susman Godfrey LLP 20110420.
Howe, M. Fractus's Response to Defendants' Motion to Clarify Claim Construction—Document 887 Susman and Godfrey 20110425.
Love, J. Minute Entry re Hearing on Apr. 21, 2011—Document 890 United States Distric Court for the Eastern Distric of Texas—Tyler Division 20110427.
NA Infringement Chart—UTStarcom CDM7126. Fractus 20091105.
NA Infringement Chart—Sanyo Katana II. Fractus 20091105.
NA Infringement Chart—Sanyo Katana LX Fractus 20091105.
NA Infringement Chart—Samsung SPH-M550 Fractus 20091105.
NA Infringement Chart—Samsung SGH T919 Fractus 20091105.
NA Infringement Chart—Samsung SGH T439 Fractus 20091105.
NA Infringement Chart—Samsung SGH T229 Fractus 20091105.
NA Infringement Chart—Samsung SGH A867 Fractus 20091105.
NA Infringement Chart—Samsung SGH A117 Fractus 20091105.
NA Infringement Chart—Samsung SGH-T929 Fractus 20091105.
NA Infringement Chart—Samsung SGH-T639 Fractus 20091105.
NA Infringement Chart—Samsung SGH-T559 Fractus 20091105.
NA Infringement Chart—Samsung SGH-T219. Fractus 20091105.
NA Infringement Chart—Samsung SGH-A837 Fractus 20091105.
NA Infringement Chart—Samsung SGH A437 Fractus 20091105.
NA Infringement Chart—Samsung SGH-A257 Fractus 20091105.
NA Infringement Chart—Samsung SGH-A237 Fractus 20091105.
NA Infringement Chart—Samsung SCH U700 Fractus 20091105.
NA Infringement Chart—Samsung SCH U410. Fractus 20091105.
NA Infringement Chart—Samsung SCH U340. Fractus 20091105.
NA Infringement Chart—Samsung SCH A127. Fractus 20091105.
NA Infringement Chart—Samsung SCH-U940 Fractus 20091105.
NA Infringement Chart—Samsung SCH-U750 Fractus 20091105.
NA Infringement Chart—Samsung SCH-U520 Fractus 20091105.
NA Infringement Chart—Samsung SCH-U310 Fractus 20091105.
NA Infringement Chart—Samsung SCH-R600 Fractus 20091105.
NA Infringement Chart—Samsung SCH-R500. Fractus 20091105.
NA Infringement Chart—Samsung SCH-R430 Fractus 20091105.
NA Infringement Chart—Samsung SCH-A645 Fractus 20091105.
NA Infringement Chart—Samsung M320 Fractus 20091105.
NA Infringement Chart—Samsung FlipShot SCH-U900 Fractus 20091105.

NA Infringement Chart—Pantech DUO C810. Fractus 20091105.
NA Infringement Chart—Pantech Breeze C520. Fractus 20091105.
NA Infringement Chart—LG VX9400 Fractus 20091105.
NA Infringement Chart—LG VX8560 Chocolate 3 Fractus 20091105.
NA Infringement Chart—LG VX8360. Fractus 20091105.
NA Infringement Chart—LG VX8350 Fractus 20091105.
NA Infringement Chart—LG VX5500 Fractus 20091105.
NA Infringement Chart—LG VX5400 Fractus 20091105.
NA Infringement Chart—LG VU CU920 Fractus 20091105.
NA Infringement Chart—LG Voyager VX10000 Fractus 20091105.
NA Infringement Chart—LG Shine CU720 Fractus 20091105.
NA Infringement Chart—LG Rumor Fractus 20091105.
NA Infringement Chart—LG MUZIQ LX570 Fractus 20091105.
NA Infringement Chart—LG Lotus Fractus 20091105.
NA Infringement Chart—LG Flare LX165 Fractus 20091105.
NA Infringement Chart—LG EnV3 VX9200. Fractus 20091105.
NA Infringement Chart—LG enV Touch VX1100. Fractus 20091105.
NA Infringement Chart—LG Chocolate VX8550 Fractus 20091105.
NA Infringement Chart—LG AX8600 Fractus 20091105.
NA Infringement Chart—LG AX380 Fractus 20091105.
NA Infringement Chart—LG AX155. Fractus 20091105.
NA Infringement Chart—LG Aloha LX140. Fractus 20091105.
NA Infringement Chart—Kyocera S2400 Fractus 20091105.
NA Infringement Chart—Kyocera NEO E1100 Fractus 20091105.
NA Infringement Chart—Kyocera MARBL Fractus 20091105.
NA Infringement Chart—RIM Blackberry 8830 Fractus 20091105.
NA Infringement Chart—RIM Blackberry 8820 Fractus 20091105.
NA Infringement Chart—RIM Blackberry 8330 Fractus 20091105.
NA Infringement Chart—RIM Blackberry 8320 Fractus 20091105.
NA Infringement Chart—RIM Blackberry 8310 Fractus 20091105.
NA Infringement Chart—RIM Blackberry 8220 Fractus 20091105.
NA Infringement Chart—RIM Blackberry 8130 Fractus 20091105.
NA Infringement Chart—RIM Blackberry 8120 Fractus 20091105.
NA Infringement Chart—RIM Blackberry 8110 Fractus 20091105.
NA Infringement Chart—RIM Blackberry Pearl 8100 Fractus 20091105.
Menefee, J. Office Action of U.S. Appl. No. 95/000,590 and 95/001,462, dated May 6, 2011 USPTO 20110506.
The oral and videotaped deposition of Dwight Jaggard. vol. 1, dated Mar. 8, 2011.
The oral and videotaped deposition of Dwight Jaggard. vol. 2, dated Mar. 9, 2011.
The oral and videotaped deposition of Dwight Jaggard. vol. 3, dated Mar. 10, 2011.
Transcript of pretrial hearing before the Honorable Leonard Davis, US District Judge—2:00 PM—dated May 16, 2011.
Transcript of jury trial before the Honorable Leonard Davis US District Judge—8:00 AM—dated May 17, 2011.
Transcript of jury trial before the Honorable Leonard Davis, US District Judge—1:10 PM—dated May 17, 2011.
Transcript of jury trial before the Honorable Leonard Davis—1:00 PM—dated May 18, 2011.
Transcript of jury trial before the Honorable Leonard Davis—8:45 AM—dated May 18, 2011.
Transcript of jury trial before the Honorable Leonard Davis—8:30 AM—dated on May 20, 2011.
Transcript of jury trial before the Honorable Leonard Davis—1:00 PM—dated May 19, 2011.
Transcript of jury trial before the Honorable Leonard Davis—8:45 AM—dated May 19, 2011.
Transcript of jury trial before the Honorable Leonard Davis—12:30 PM—dated on May 20, 2011.
Transcript of jury trial before the Honorable Leonard Davis—8:55 AM—dated on May 23, 2011.
Demonstratives presented by Dr. Stuart Long during trial, dated May 18, 2011.
Demonstratives presented by Dr. Steven Best during trial, dated May 19, 2011.
Campos, O., Multiband and miniature fractal antennas study: Estudi d'antenes fractal multibanda i en miniatura, Universitat Politecnica de Catalunya, 1998.
Verdura, O., Miniature fractal antenna: Antena fractal miniatura, Universitat Politecnica de Catalunya, Sep. 1997.
Borja, C., Fractal microstrip antennas: Antenas fractales microstrip, Universitat Poltecnica de Catalunya, Jul. 1997.
Oral and videotaped deposition of Dr. Stuart Long—vol. 1, dated Mar. 11, 2011.
Oral and videotaped deposition of Dr. Stuart Long—vol. 2, dated Mar. 13, 2011.
Oral and videotaped deposition of Dr. Stuart Long—vol. 3, dated Mar. 14, 2011.
Oral and videotaped deposition of Dr. Warren L. Stutzman—vol. 1, dated Mar. 3, 2011.
Oral and videotaped deposition of Dr. Warren L. Stutzman—vol. 2, dated Mar. 4, 2011.
Document 1082—Joint motion to dismiss HTC, dated Sep. 13, 2011.
Document 1083—Order—Final consent judgement HTC, dated Sep. 15, 2011.
Document 1088—Samsung's motion to determine intervening rights in view of new Federal Circuit case law or, in the alternative, to stay the case pending the outcome of reexamination, dated Oct. 19, 2011.
Document 1091—Fractus's response to Samsung's motion to determine intervening rights or to stay the case pending the outcome of reexamination, dated Nov. 2, 2011.
Document 1092—Samsung's reply in support of its motion to determine intervening rights in view of new Federal Circuit case law or, in the alternative, to stay the case pending the outcome of reexamination, dated Nov. 14, 2011.
Action dosing prosecution for U.S. Appl. No. 7/411,556—95/000,590, 95/001,462, dated Dec. 14, 2011.
Inter partes reexamination of U.S. Appl. No. 7/411,556—95/00,1462, 95/001,590—Third party requester's comments to patent owner's reply of Aug. 8, 2011, dated Sep. 7, 2011.
US95/001462, US95/000590—Patent owners response to Action Closing Prosecution for U.S. Appl. No. 7/411,556, dated Jan. 17, 2012.
95/0001462, 95/000590—Third party requester's comments to patent owner's reply of Jan. 07, 2012 for U.S. Appl. No. 7/411,556, dated Feb. 16, 2012.
95/001462, 95/000590—Right of Appeal Notice for U.S. Appl. No. 7/411,556, dated Mar. 12, 2012.
Laufer, P. M. Dedsion sua sponte to merge reexamination proceedings of U.S. Appl. No. 7/411,556 and reexamination Nos. 95/000590—95/001462. USPTO. May 5, 2011.
Mittra, R. Response to the Office Action dated May 6, 2011 of U.S. Appl. No. US7/411,556 reexam control No. 95/001462—95/000590. Sterne Kessler. Aug. 6, 2011.
U.S. Appl. No. 95/001,462, 95/00,0590—Third party requesters notice of appeal for U.S. Appl. No. 7/411,556, dated Apr. 12, 2012.
U.S. Appl. No. 95/001,462, 95/000,590—Reply to Third Party Requester's notice of appeal filed Apr. 12, 2012 for U.S. Appl. No. 7/411,556, dated May 31, 2012.
U.S. Appl. No. 13/029,382—Notice of allowance, dated May 10, 2012.

* cited by examiner

MULTI-BAND MONOPOLE ANTENNA FOR A MOBILE COMMUNICATIONS DEVICE

CROSS-REFERENCE TO RELATED APPLICATIONS

This patent application is a continuation application of, and incorporates by reference the entire disclosure of, U.S. patent application Ser. No. 12/055,748, which was filed on Mar. 26, 2008 now U.S. Pat. No. 7,675,470. U.S. patent application Ser. No. 12/055,748 is a continuation application of Ser. No. 11/713,324, filed Mar. 2, 2007, now U.S. Pat. No. 7,403,164, issued on Jul. 22, 2008. U.S. Pat. No. 7,403,164 is a continuation application of Ser. No. 11/124,768, filed May 9, 2005, now U.S. Pat. No. 7,411,556, issued on Aug. 12, 2008. U.S. Pat. No. 7,411,556 is a continuation application of International Patent Application No. PCT/EP02/14706, filed on Dec. 22, 2002. This patent application incorporates U.S. patent application Ser. No. 12/055,748, U.S. Pat. No. 7,403,164, U.S. Pat. No. 7,411,556, and International Patent Application No. PCT/EP02/14706 by reference.

BACKGROUND OF THE INVENTION

1. Technical Field of the Invention

This invention relates generally to the field of multi-band monopole antennas. More specifically, a multi-band monopole antenna is provided that is particularly well-suited for use in mobile communications devices, such as Personal Digital Assistants, cellular telephones, and pagers.

2. Description of Related Art

Multi-band antenna structures for use in a mobile communications device are known in this art. For example, one type of antenna structure that is commonly utilized as an internally-mounted antenna for a mobile communication device is known as an "inverted-F" antenna. When mounted inside a mobile communications device, an antenna is often subject to problematic amounts of electromagnetic interference from other metallic objects within the mobile communications device, particularly from the ground plane. An inverted-F antenna has been shown to perform adequately as an internally mounted antenna, compared to other known antenna structures. Inverted-F antennas, however, are typically bandwidth-limited, and thus may not be well suited for bandwidth intensive applications.

SUMMARY OF THE INVENTION

A multi-band monopole antenna for a mobile communications device includes a common conductor coupled to both a first radiating arm and a second radiating arm. The common conductor includes a feeding port for coupling the antenna to communications circuitry in a mobile communications device. In one embodiment, the first radiating arm includes a space-filling curve. In another embodiment, the first radiating arm includes a meandering section extending from the common conductor in a first direction and a contiguous extended section extending from the meandering section in a second direction.

A mobile communications device having a multi-band monopole antenna includes a circuit board, communications circuitry, and the multi-band monopole antenna. The circuit board includes an antenna feeding point and a ground plane. The communications circuitry is coupled to the antenna feeding point of the circuit board. The multi-band monopole antenna includes a common conductor, a first radiating arm and a second radiating arm. The common conductor includes a feeding port that is coupled to the antenna feeding point of the circuit board. The first radiating arm is coupled to the common conductor and includes a space-filling curve. The second radiating arm is coupled to the common conductor. In one embodiment, the circuit board is mounted in a first plane within the mobile communications device and the multi-band monopole antenna is mounted in a second plane within the mobile communications device.

DETAILED DESCRIPTION OF THE DRAWINGS

Figure 1:
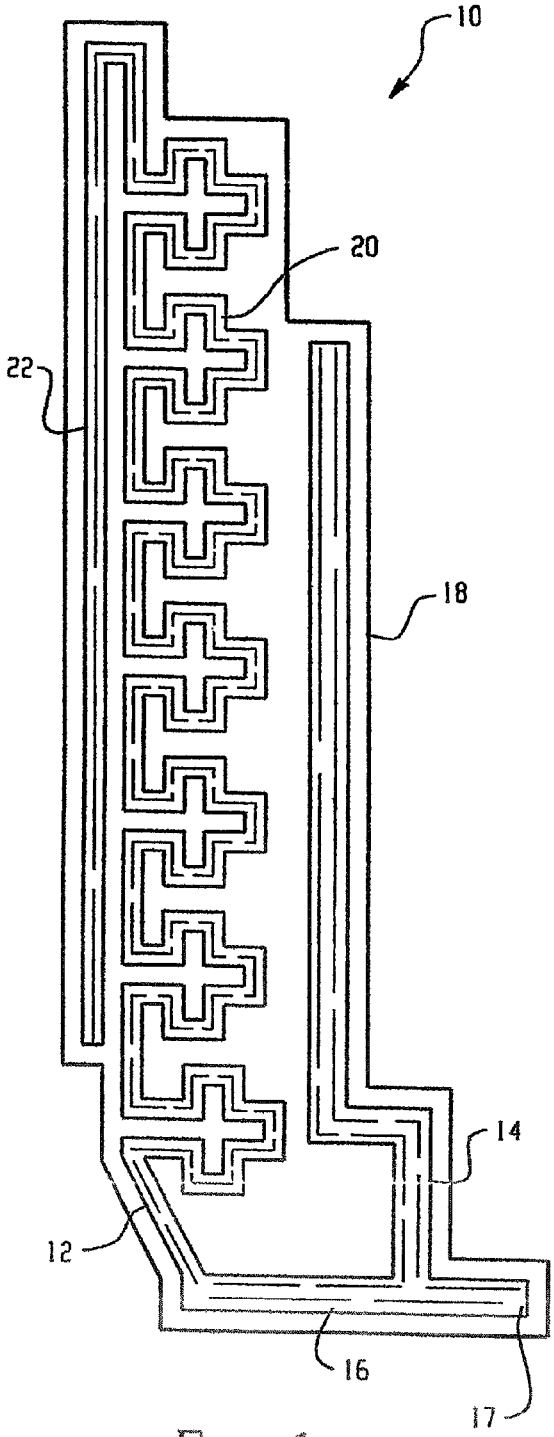
FIG. 1 is a top view of an exemplary multi-band monopole antenna for a mobile communications device.

Referring now to the drawing figures, FIG. 1 is a top view of an exemplary multi-band monopole antenna 10 for a mobile communications device. The multi-band monopole antenna 10 includes a first radiating arm 12 and a second radiating arm 14 that are both coupled to a feeding port 17 through a common conductor 16. The antenna 10 also includes a substrate material 18 on which the antenna structure 12, 14, 16 is fabricated, such as a dielectric substrate, a flex-film substrate, or some other type of suitable substrate material. The antenna structure 12, 14, 16 is preferably patterned from a conductive material, such as a metallic thick-film paste that is printed and cured on the substrate material 18, but may alternatively be fabricated using other known fabrication techniques.

The first radiating arm 12 includes a meandering section 20 and an extended section 22. The meandering section 20 is coupled to and extends away from the common conductor 16. The extended section 22 is contiguous with the meandering section 20 and extends from the end of the meandering section 20 back towards the common conductor 16. In the illustrated embodiment, the meandering section 20 of the first radiating arm 12 is formed into a geometric shape known as a space-filling curve, in order to reduce the overall size of the antenna 10. A space-filling curve is characterized by at least ten segments which are connected in such a way that each segment forms an angle with its adjacent segments, that is, no pair of adjacent segments define a larger straight segment. It should be understood, however, that the meandering section 20 may include other space-filling curves than that shown in FIG. 1, or may optionally be arranged in an alternative meandering geometry. FIGS. 2-6, for example, illustrate antenna structures having meandering sections formed from several alternative geometries. The use of shape-filling curves to form antenna structures is described in greater detail in the co-owned PCT Application WO 01/54225, entitled Space-Filling Miniature Antennas, which is hereby incorporated into the present application by reference.

The second radiating arm 14 includes three linear portions. As viewed in FIG. 1, the first linear portion extends in a vertical direction away from the common conductor 16. The second linear portion extends horizontally from the end of the first linear portion towards the first radiating arm. The third linear portion extends vertically from the end of the second linear portion in the same direction as the first linear portion and adjacent to the meandering section 20 of the first radiating arm 14.

Figure 10:
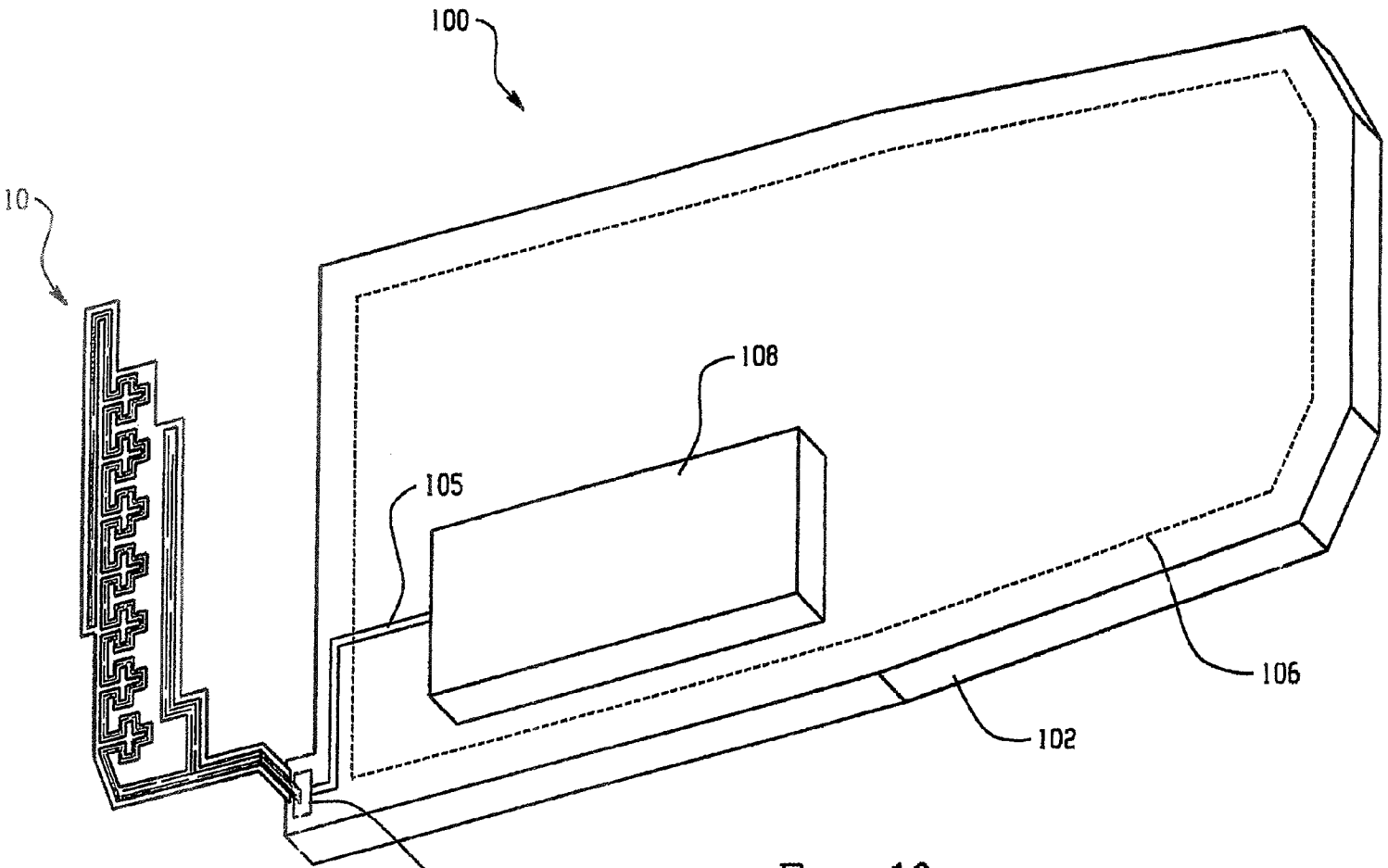
FIG. 10 is a top view of the exemplary multi-band monopole antenna of FIG. 1 coupled to a circuit board for a mobile communications device.

As noted above, the common conductor 16 of the antenna 10 couples the feeding port 17 to the first and second radiating arms 12, 14. The common conductor 16 extends horizontally (as viewed in FIG. 1) beyond the second radiating arm 14, and may be folded in a perpendicular direction (perpendicularly into the page), as shown in FIG. 10, in order to couple the feeding port 17 to communications circuitry in a mobile communications device.

Operationally, the first and second radiating arms 12, 14 are each tuned to a different frequency band, resulting in a dual-band antenna. The antenna 10 may be tuned to the desired dual-band operating frequencies of a mobile communications device by pre-selecting the total conductor length of each of the radiating arms 12, 14. For example, in the illustrated embodiment, the first radiating arm 12 may be tuned to operate in a lower frequency band or groups of bands, such as PDC (800 MHz), CDMA (800 MHz), GSM (850 MHz), GSM (900 MHz), GPS, or some other desired frequency band. Similarly, the second radiating arm 14 may be tuned to operate in a higher frequency band or group of bands, such as GPS, PDC (1500 MHz), GSM (1800 MHz), Korean PCS, CDMA/PCS (1900 MHz), CDMA2000/UMTS, IEEE 802.11 (2.4 GHz), or some other desired frequency band. It should be understood that, in some embodiments, the lower frequency band of the first radiating arm 12 may overlap the higher frequency band of the second radiating arm 14, resulting in a single broader band. It should also be understood that the multi-band antenna 10 may be expanded to include further frequency bands by adding additional radiating arms. For example, a third radiating arm could be added to the antenna 10 to form a tri-band antenna.

Figure 2:
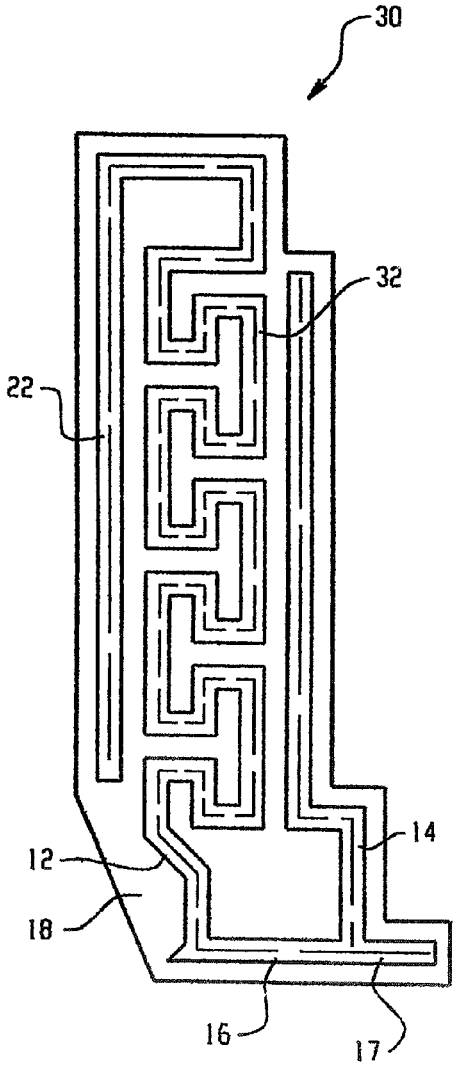
FIG. 2 is a top view of an exemplary multi-band monopole antenna including one alternative space-filling geometry.

FIG. 2 is a top view of an exemplary multi-band monopole antenna 30 including one alternative space-filling geometry. The antenna 30 show in FIG. 2 is similar to the multi-band antenna 10 shown in FIG. 1, except the meandering section 32 in the first radiating arm 12 includes a different space-filling curve than that shown in FIG. 1.

FIGS. 3-9 illustrate several alternative multi-band monopole antenna configurations 50, 70, 80, 90, 93, 95, 97. Similar to the antennas 10, 30 shown in FIGS. 1 and 2, the multi-band monopole antenna 50 illustrated in FIG. 3 includes a common conductor 52 coupled to a first radiating arm 54 and a second radiating arm 56. The common conductor 52 includes a feeding port 62 on a linear portion of the common conductor 52 that extends horizontally (as viewed in FIG. 3) away from the radiating arms 54, 56, and that may be folded in a perpendicular direction (perpendicularly into the page) in order to couple the feeding port 62 to communications circuitry in a mobile communications device.

The first radiating arm 54 includes a meandering section 58 and an extended section 60. The meandering section 58 is coupled to and extends away from the common conductor 52. The extended section 60 is contiguous with the meandering section 58 and extends from the end of the meandering section 58 in an arcing path back towards the common conductor 52.

The second radiating arm 56 includes three linear portions. As viewed in FIG. 3, the first linear portion extends diagonally away from the common conductor 52. The second linear portion extends horizontally from the end of the first linear portion towards the first radiating arm. The third linear portion extends vertically from the end of the second linear portion away from the common conductor 52 and adjacent to the meandering section 58 of the first radiating arm 54.

Figure 3:
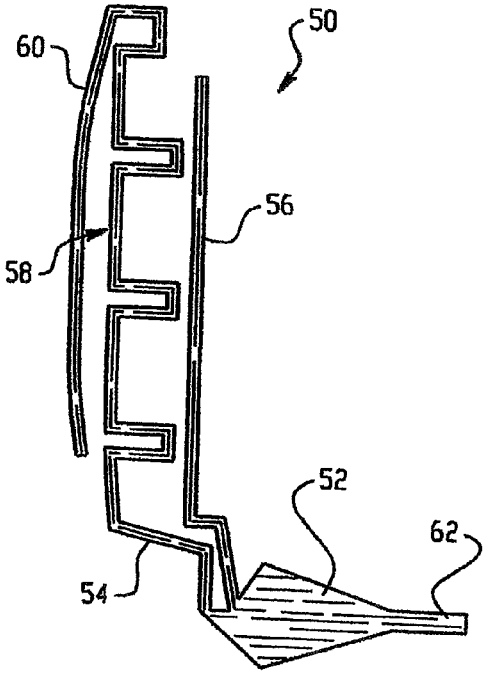
FIGS. 3-9 illustrate several alternative multi-band monopole antenna configurations.
Figure 4:
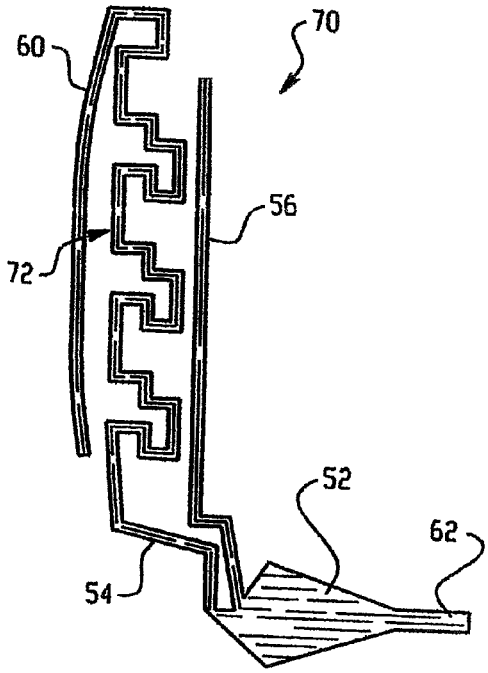
Figure 5:
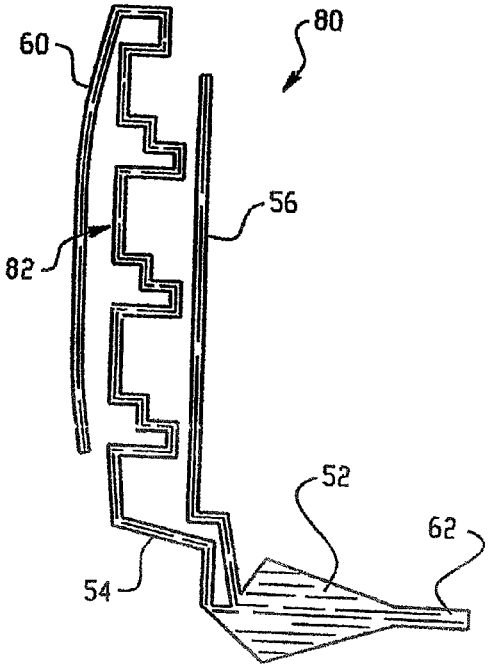
Figure 6:
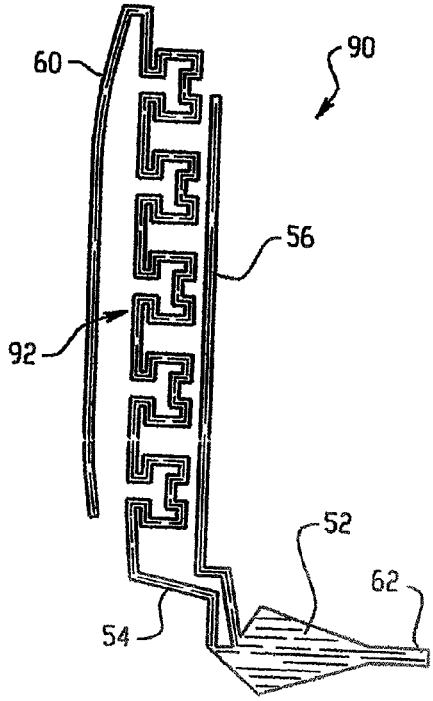

The multi-band monopole antennas 70, 80, 90 illustrated in FIGS. 4-6 are similar to the antenna 50 shown in FIG. 3, except each includes a differently-patterned meandering portion 72, 82, 92 in the first radiating arm 54. For example, the meandering portion 92 of the multi-band antenna 90 shown in FIG. 6 meets the definition of a space-filling curve, as described above. The meandering portions 58, 72, 82 illustrated in FIGS. 3-5, however, each include differently-shaped periodic curves that do not meet the requirements of a space-filling curve.

Figure 9:
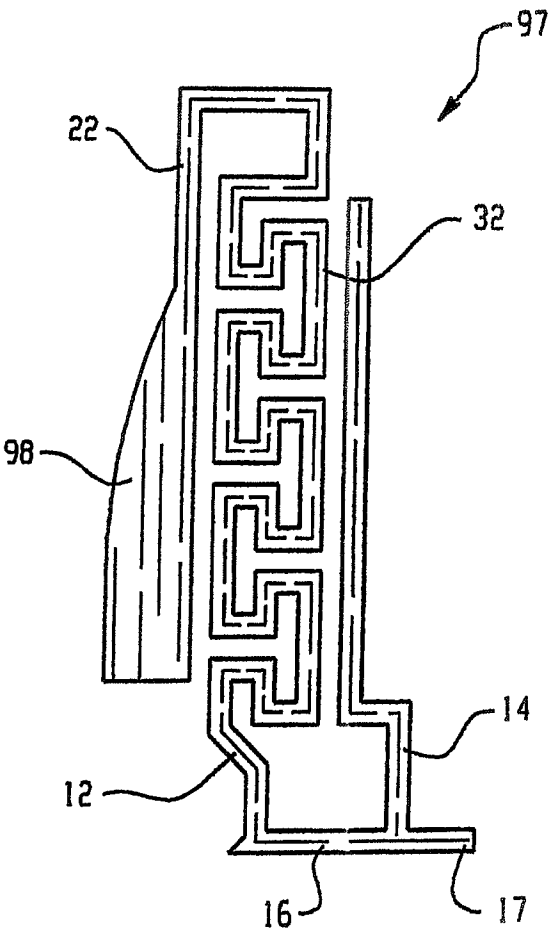
Figure 8:
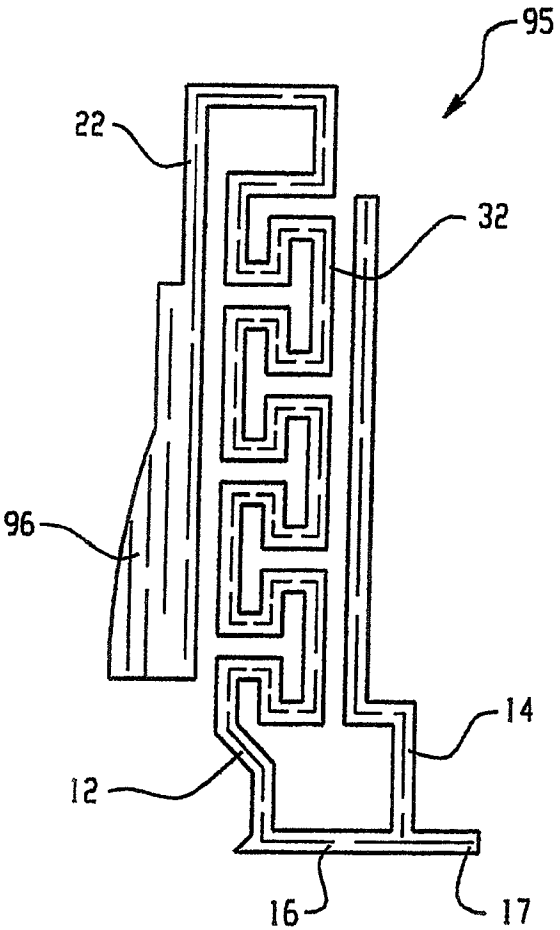
Figure 7:
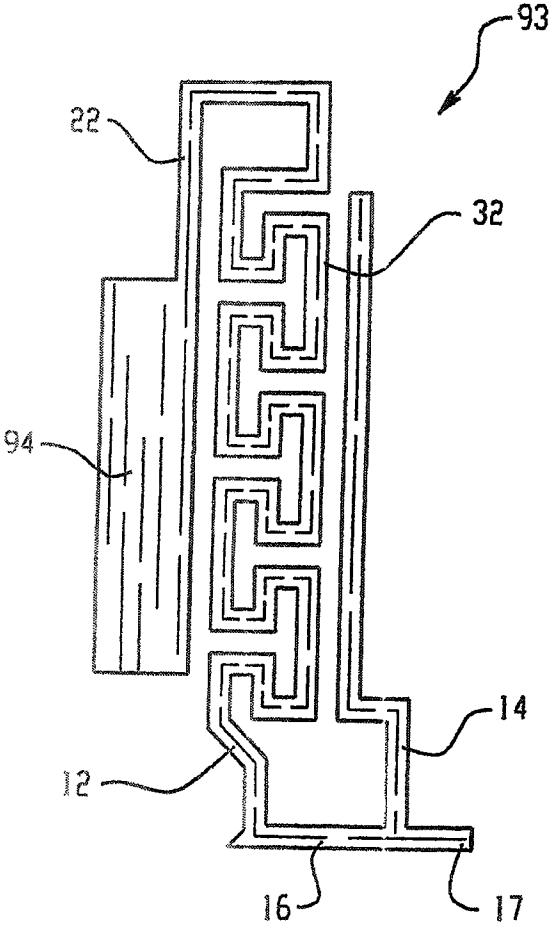

The multi-band monopole antennas 93, 95, 97 illustrated in FIGS. 7-9 are similar to the antenna 30 shown in FIG. 2, except in each of FIGS. 7-9 the expanded portion 22 of the first radiating arm 12 includes an additional area 94, 96, 98. In FIG. 7, the expanded portion 22 of the first radiating arm 12 includes a polygonal portion 94. In FIGS. 8 and 9, the expanded portion 22 of the first radiating arm 12 includes a portion 96, 98 with an arcuate longitudinal edge.

FIG. 10 is a top view 100 of the exemplary multi-band monopole antenna 10 of FIG. 1 coupled to the circuit board 102 of a mobile communications device. The circuit board 102 includes a feeding point 104 and a ground plane 106. The ground plane 106 may, for example, be located on one of the surfaces of the circuit board 102, or may be one layer of a multi-layer printed circuit board. The feeding point 104 may, for example, be a metallic bonding pad that is coupled to circuit traces 105 on one or more layers of the circuit board 102. Also illustrated, is communication circuitry 108 that is coupled to the feeding point 104. The communication circuitry 108 may, for example, be a multi-band transceiver circuit that is coupled to the feeding point 104 through circuit traces 105 on the circuit board.

In order to reduce electromagnetic interference from the ground plane 106, the antenna 10 is mounted within the mobile communications device such that the projection of the antenna footprint on the plane of the circuit board 102 does not intersect the metalization of the ground plane 106 by more than fifty percent. In the illustrated embodiment 100, the antenna 10 is mounted above the circuit board 102. That is, the circuit board 102 is mounted in a first plane and the antenna 10 is mounted in a second plane within the mobile communications device. In addition, the antenna 10 is laterally offset from an edge of the circuit board 102, such that, in this embodiment 100, the projection of the antenna footprint on the plane of the circuit board 102 does not intersect any of the metalization of the ground plane 106.

In order to further reduce electromagnetic interference from the ground plane 106, the feeding point 104 is located at a position on the circuit board 102 adjacent to a corner of the ground plane 106. The antenna 10 is preferably coupled to the feeding point 104 by folding a portion of the common conductor 16 perpendicularly towards the plane of the circuit board 102 and coupling the feeding port 17 of the antenna 10 to the feeding point 104 of the circuit board 102. The feeding port 17 of the antenna 10 may, for example, be coupled to the feeding point 104 using a commercially available connector, by bonding the feeding port 17 directly to the feeding point 104, or by some other suitable coupling means. In other embodiments, however, the feeding port 17 of the antenna 10 may be coupled to the feeding point 104 by some means other than folding the common conductor 16.

Figure 11:
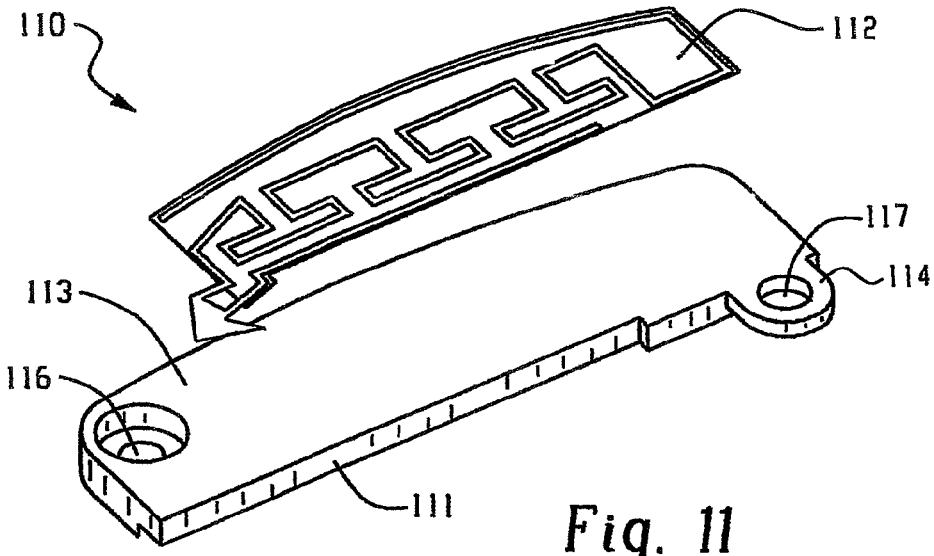
FIG. 11 shows an exemplary mounting structure for securing a multi-band monopole antenna within a mobile communications device.

FIG. 11 shows an exemplary mounting structure 111 for securing a multi-band monopole antenna 112 within a mobile communications device. The illustrated embodiment 110 employs a multi-band monopole antenna 112 having a meandering section similar to that shown in FIG. 2. It should be understood, however, that alternative multi-band monopole antenna configurations, as described in FIGS. 1-9, could also be used.

The mounting structure 111 includes a flat surface 113 and at least one protruding section 114. The antenna 112 is secured to the flat surface 113 of the mounting structure 111, preferably using an adhesive material. For example, the antenna 112 may be fabricated on a flex-film substrate having a peel-type adhesive on the surface opposite the antenna structure. Once the antenna 112 is secured to the mounting structure 111, the mounting structure 111 is positioned in a mobile communications device with the protruding section 114 extending over the circuit board. The mounting structure 111 and antenna 112 may then be secured to the circuit board and to the housing of the mobile communications device using one or more apertures 116, 117 within the mounting structure 111.

Figure 12:
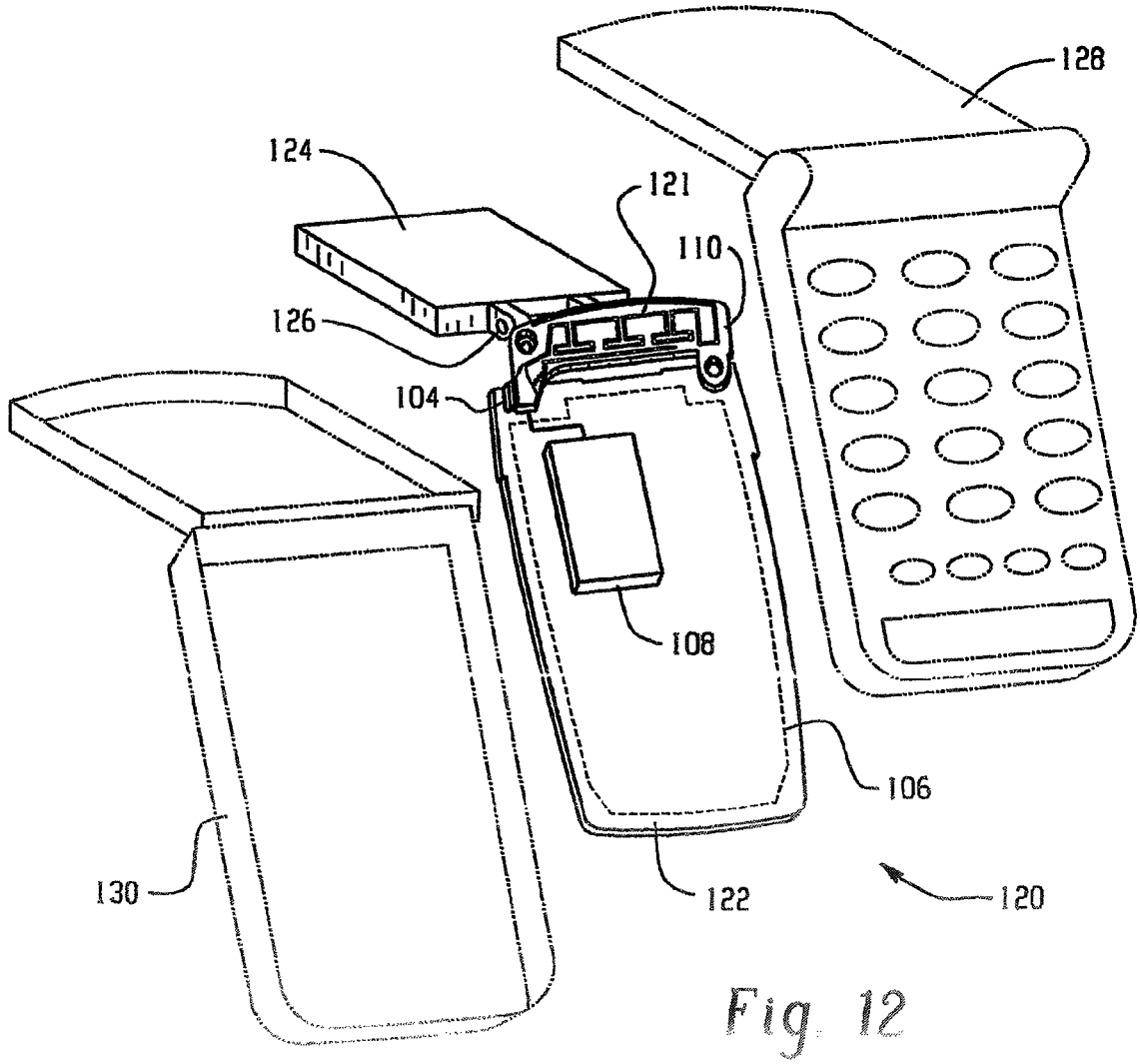
FIG. 12 is an exploded view of an exemplary clamshell-type cellular telephone having a multi-band monopole antenna.

FIG. 12 is an exploded view of an exemplary clamshell-type cellular telephone 120 having a multi-band monopole antenna 121. The cellular telephone 120 includes a lower circuit board 122, an upper circuit board 124, and the multi-band antenna 121 secured to a mounting structure 110. Also illustrated are an upper and a lower housing 128, 130 that join to enclose the circuit boards 122, 124 and antenna 121. The illustrated multi-band monopole antenna 121 is similar to the multi-band antenna 30 shown in FIG. 2. It should be understood, however, that alternative antenna configurations, as described above with reference to FIGS. 1-9, could also be used.

The lower circuit board 122 is similar to the circuit board 102 described above with reference to FIG. 10, and includes a ground plane 106, a feeding point 104, and communications circuitry 108. The multi-band antenna 121 is secured to a mounting structure 110 and coupled to the lower circuit board 122, as described above with reference to FIGS. 10 and 11. The lower circuit board 122 is then connected to the upper circuit board 124 with a hinge 126, enabling the upper and lower circuit boards 122, 124 to be folded together in a manner typical for clamshell-type cellular phones. In order to further reduce electromagnetic interference from the upper and lower circuit boards 122, 124, the multi-band antenna 121 is preferably mounted on the lower circuit board 122 adjacent to the hinge 126.

Figure 13:
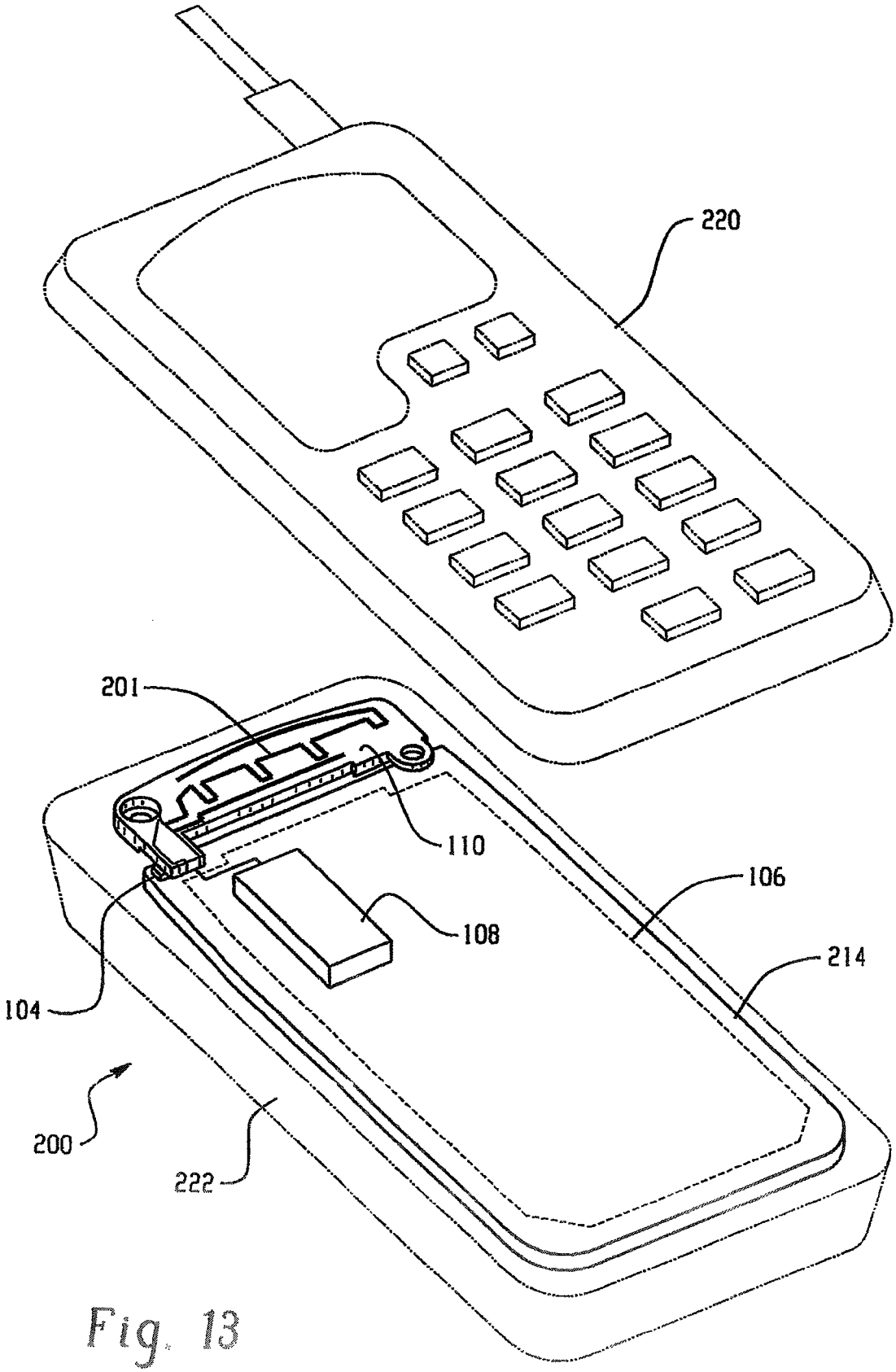
FIG. 13 is an exploded view of an exemplary candy-bar-style cellular telephone having a multi-band monopole antenna.

FIG. 13 is an exploded view of an exemplary candy-bar-type cellular telephone 200 having a multi-band monopole antenna 201. The cellular telephone 200 includes the multi-band monopole antenna 201 secured to a mounting structure 110, a circuit board 214, and an upper and lower housing 220, 222. The circuit board 214 is similar to the circuit board 102 described above with reference to FIG. 10, and includes a ground plane 106, a feeding point 104, and communications circuitry 108. The illustrated antenna 201 is similar to the multi-band monopole antenna shown in FIG. 3, however alternative antenna configurations, as described above with reference to FIGS. 1-9, could also be used.

The multi-band antenna 201 is secured to the mounting structure 110 and coupled to the circuit board 214 as described above with reference to FIGS. 10 and 11. The upper and lower housings 220, 222 are then joined to enclose the antenna 212 and circuit board 214.

Figure 14:
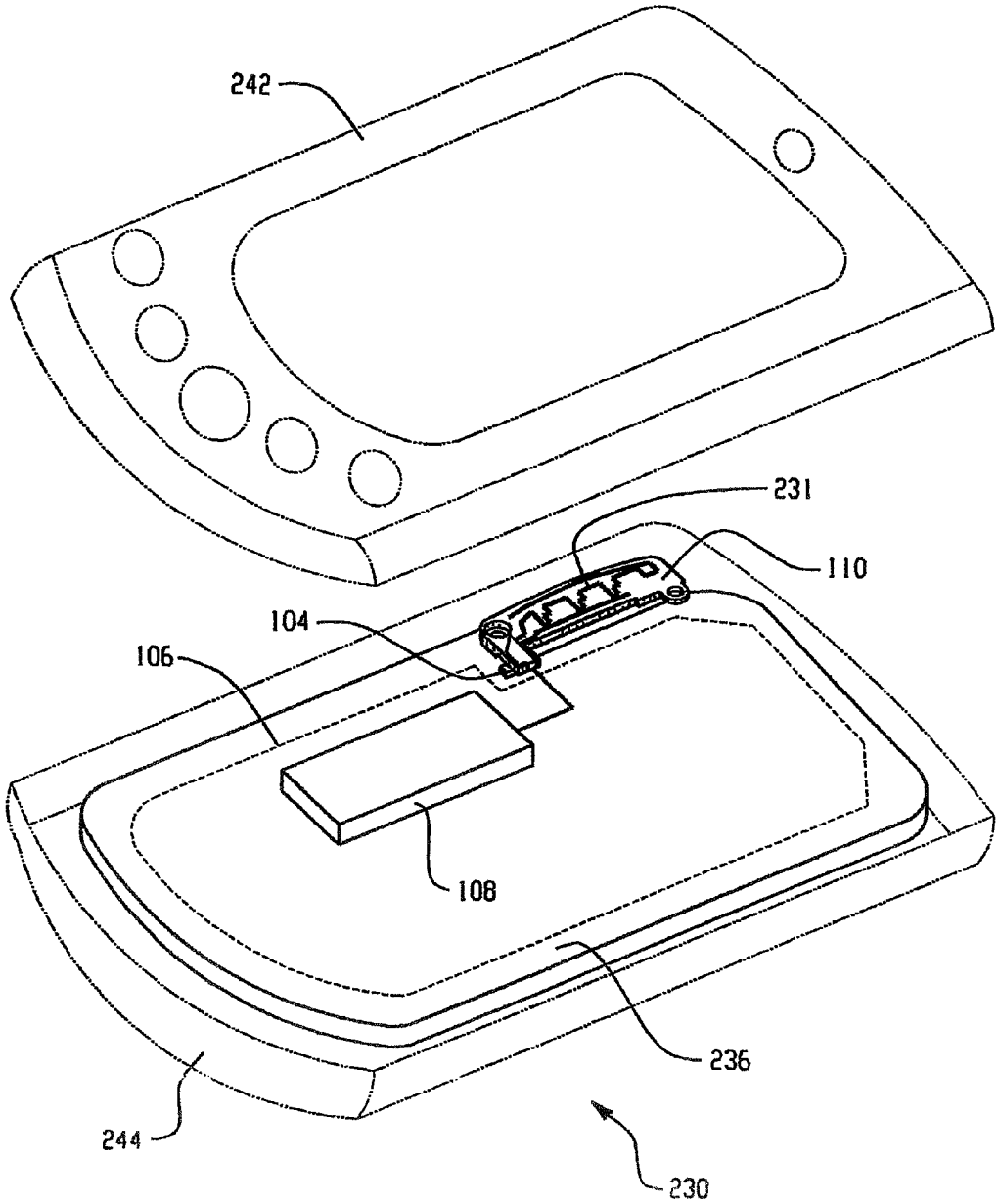
FIG. 14 is an exploded view of an exemplary personal digital assistant (PDA) having a multi-band monopole antenna.

FIG. 14 is an exploded view of an exemplary personal digital assistant (PDA) 230 having a multi-band monopole antenna 231. The PDA 230 includes the multi-band monopole antenna 231 secured to a mounting structure 110, a circuit board 236, and an upper and lower housing 242, 244. Although shaped differently, the PDA circuit board 236 is similar to the circuit board 102 described above with reference to FIG. 10, and includes a ground plane 106, a feeding point 104, and communications circuitry 108. The illustrated antenna 231 is similar to the multi-band monopole antenna shown in FIG. 5, however alternative antenna configurations, as described above with reference to FIGS. 1-9, could also be used.

The multi-band antenna 231 is secured to the mounting structure 110 and coupled to the circuit board 214 as described above with reference to FIGS. 10 and 11. In slight contrast to FIG. 10, however, the PDA circuit board 236 defines an L-shaped slot along an edge of the circuit board 236 into which the antenna 231 and mounting structure 110 are secured in order to conserve space within the PDA 230. The upper and lower housings 242, 244 are then joined together to enclose the antenna 231 and circuit board 236.

This written description uses examples to disclose the invention, including the best mode, and also to enable any person skilled in the art to make and use the invention. The patentable scope of the invention is defined by the claims, and may include other examples that occur to those skilled in the art.

What is claimed is:

1. A cellular telephone handset, comprising:
- a device housing;
- a display;
- a keyboard;
- a speaker;
- a printed circuit board, the printed circuit board comprising:
  - a ground plane layer;
  - a feeding point;
- a communication circuitry energized by means of a battery;
- wherein the communication circuitry is mounted on the printed circuit board;
- wherein the communication circuitry is coupled to the feeding point and to the ground plane layer;
- an antenna including an antenna element;
- wherein the antenna element operates in cooperation with the ground plane layer;
- the antenna element comprising:
  - a common conductor including a feeding port;
  - a first longer radiating arm connected to the common conductor;
  - a second shorter radiating arm connected to the common conductor;
- wherein the feeding port is coupled to the feeding point;
- wherein an orthogonal projection of a footprint of the antenna element on a plane of the printed circuit board overlaps the ground plane layer in less than 50% of an area of said footprint;
- wherein the display, the speaker, the printed circuit board, the communication circuitry, and the antenna are arranged inside the device housing; and
- wherein the antenna and the cellular telephone handset operate at multiple frequency bands.

2. The cellular telephone handset according to claim 1, wherein the printed circuit board further comprises a plurality of circuit traces; and wherein a circuit trace of the plurality of circuit traces couples the communication circuitry to the feeding point.

3. The cellular telephone handset according to claim 2, wherein the device housing comprises:

an upper housing, the upper housing including a window;

a lower housing, the lower housing adapted to receive the upper housing;

wherein the display is arranged with respect to the upper housing so as to be visible through the window; and wherein the keyboard is arranged within the device housing so as to be accessible through the upper housing.

4. The cellular telephone handset according to claim 1, wherein the first longer radiating arm is bent.

5. The cellular telephone handset according to claim 4, wherein:

the first longer arm comprises a first section extending away from the common conductor in a first direction and a second section extending in a second direction; and wherein the second direction is different from the first direction.

6. The cellular telephone handset according to claim 5, wherein the second direction is substantially opposite to the first direction.

7. The cellular telephone handset according to claim 5, wherein the first section is at least partially shaped as a space-filling curve.

8. The cellular telephone handset according to claim 5, wherein the first section is at least a partially shaped as a substantially periodic meander line.

9. The cellular telephone handset according to claim 1, wherein the communication circuitry comprises a transceiver able to operate at multiple frequency bands.

10. The cellular telephone handset according to claim 1, wherein the cellular telephone handset comprises a mounting structure arranged within the device housing; and wherein the antenna element is arranged on at least one surface of the mounting structure.

11. The cellular telephone handset according to claim 10, wherein the mounting structure is secured to the printed circuit board.

12. The cellular telephone handset according to claim 10, wherein the mounting structure is secured to the device housing.

13. The cellular telephone handset according to claim 1, wherein the antenna element is fabricated on a surface of a flexible substrate.

14. The cellular telephone handset according to claim 13, wherein:

the flexible substrate comprises an adhesive layer; and wherein the flexible substrate is affixed to the device housing.

15. The cellular telephone handset according to claim 1, wherein the cellular telephone handset comprises:

a second printed circuit board;

mechanical connecting means; and wherein the mechanical connecting means enables the second printed circuit board to move with respect to the printed circuit board, so that the cellular telephone handset can be switched between an open configuration and a closed configuration.

16. The cellular telephone handset according to claim 15, wherein the second printed circuit board includes a second ground plane layer; and wherein the cellular telephone handset comprises electrical connecting means adapted to couple the ground plane layer and the second ground plane layer.

17. The cellular telephone handset according to claim 15, wherein the mechanical connecting means comprises a hinge.

18. The cellular telephone handset according to claim 17, wherein the cellular telephone handset is a clamshell-type cellular telephone handset.

19. The cellular telephone handset according to claim 17, wherein the second printed circuit board includes a second ground plane layer; and wherein the hinge comprises electrical connecting means adapted to couple the ground plane layer and the second ground plane layer.

20. The cellular telephone handset according to claim 15, wherein an orthogonal projection of the second printed circuit board substantially overlaps the printed circuit board when the cellular telephone handset is in the closed configuration.

21. A smartphone handset, comprising:

a device housing;

a speaker;

a display, the display having an area of at least 60% of an area defined by transversal dimensions of the device housing;

a printed circuit board, the printed circuit board comprising:

a ground plane layer;

a feeding point;

a communication circuitry energized by means of a battery;

wherein the communication circuitry is mounted on the printed circuit board;

wherein the communication circuitry is coupled to the feeding point and to the ground plane layer;

an antenna, the antenna including an antenna element coupled to the feeding point of the printed circuit board and that operates in cooperation with the ground plane layer;

wherein the antenna operates at multiple frequency bands;

wherein an orthogonal projection of a footprint of the antenna element on a plane of the printed circuit board overlaps the ground plane layer in less than 50% of an area of said footprint;

wherein the speaker, the display, the printed circuit board, the communication circuitry, and the antenna are arranged inside the device housing; and wherein the smartphone handset operates at least three cellular communication services and at least one wireless connectivity service.

22. The smartphone handset according to claim 21, wherein one of the at least three cellular communication services is CDMA2000 or UMTS.

23. The smartphone handset according to claim 21, wherein the at least one wireless connectivity service is an IEEE 802.11 service.

24. The smartphone handset according to claim 21, wherein at least a portion of the antenna element is shaped as a space-filling curve.

25. The smartphone handset according to claim 21, wherein at least a portion of the antenna element is shaped as a substantially periodic meander line.

26. The smartphone handset according to claim 21, wherein the smartphone handset includes an enhanced keyboard comprising at least 19 keys.

27. The smartphone handset according to claim 26, wherein the device housing comprises:

a first housing portion, the first housing portion including a window;

a second housing portion;

mechanical connecting means, the mechanical connecting means enabling the second housing portion to move with respect to the first housing portion, so that the smartphone handset can be switched between an open configuration and a closed configuration;

wherein the display is arranged inside the first housing portion so as to be visible through the window; and wherein the enhanced keyboard is arranged inside the second housing portion so as to be accessible through the second housing portion.

28. The smartphone handset according to claim 27, wherein the display is substantially rectangular having two long sides and two short sides; and wherein the enhanced keyboard is adjacent to one of said two long sides of the display when the smartphone handset is in the open configuration.

29. The smartphone handset according to claim 21, wherein the display has an area of at least 75% of the area defined by the transversal dimensions of the device housing;

wherein the smartphone handset comprises a joystick switch button arranged adjacent to a first end of the display; and wherein the speaker is arranged adjacent to a second end of the display, said second end being opposite to said first end.

30. The smartphone handset according to claim 29, wherein the smartphone handset comprises at least two buttons arranged adjacent to the first end of the display;

and wherein the joystick switch button is substantially centered with respect the at least two buttons.

31. The smartphone handset according to claim 21, wherein the antenna element comprises:

a common conductor including a feeding port;

a first longer radiating arm connected to the common conductor;

a second shorter radiating arm connected to the common conductor; and wherein the feeding port is coupled to the feeding point.

32. The smartphone handset according to claim 31, wherein the first longer radiating arm is bent.

33. The smartphone handset according to claim 32, wherein the first longer radiating arm comprises a first section extending away from the common conductor in a first direction and a second section extending in a second direction; and wherein the second direction is different from the first direction.

34. The smartphone handset according to claim 33, wherein the second direction is substantially opposite to the first direction.

35. The smartphone handset according to claim 31, wherein the first longer radiating arm is at least partially shaped as a space-filling curve.

36. The smartphone handset according to claim 31, wherein the first longer radiating arm is at least a partially shaped as a substantially periodic meander line.

37. The smartphone handset according to claim 31, wherein the antenna is a monopole antenna.

38. The smartphone handset according to claim 21, wherein the smartphone handset comprises a mounting structure arranged within the device housing; and wherein the antenna element is arranged on at least one surface of the mounting structure.

39. The smartphone handset according to claim 38, wherein the mounting structure is secured to the device housing.

40. The smartphone handset according to claim 21, wherein the antenna element is fabricated on a surface of a flexible substrate affixed to the device housing.

* * * * *